US010422598B2

(12) United States Patent
McCormick

(10) Patent No.: US 10,422,598 B2
(45) Date of Patent: Sep. 24, 2019

(54) SYSTEM AND METHOD FOR MAGAZINE WITH FOLDED FEED LIPS

(71) Applicant: Wilson's Gun Shop, Inc., Berryville, AR (US)

(72) Inventor: Michael L. McCormick, Austin, TX (US)

(73) Assignee: Wilson's Gun Shop, Inc., Berryville, AR (US)

( * ) Notice: Subject to any disclaimer, the term of this patent is extended or adjusted under 35 U.S.C. 154(b) by 0 days.

(21) Appl. No.: 16/120,765

(22) Filed: Sep. 4, 2018

(65) Prior Publication Data

US 2019/0015935 A1 Jan. 17, 2019

Related U.S. Application Data

(60) Division of application No. 14/991,466, filed on Jan. 8, 2016, now Pat. No. 10,183,361, which is a continuation-in-part of application No. 14/887,837, filed on Oct. 20, 2015, now Pat. No. 9,791,228.

(60) Provisional application No. 62/170,520, filed on Jun. 3, 2015, provisional application No. 62/141,746, filed on Apr. 1, 2015.

(51) Int. Cl.
*F41A 9/66* (2006.01)
*F41A 9/70* (2006.01)

(52) U.S. Cl.
CPC .. *F41A 9/66* (2013.01); *F41A 9/70* (2013.01)

(58) Field of Classification Search
CPC ..... F41A 9/65; F41A 9/66; F41A 9/70
USPC ..... 42/6, 7, 11, 17, 18, 21, 24, 29, 33, 35, 42/37, 49.01, 49.02, 50, 87
See application file for complete search history.

(56) References Cited

U.S. PATENT DOCUMENTS 1,833,862 A 11/1931 Schmeisser
1,878,039 A * 9/1932 Von Frommer ..... F41A 9/69 42/18
2,870,561 A * 1/1959 Colby ..... F41A 9/55 42/18
3,222,810 A * 12/1965 Musgrave ..... F41A 9/84 42/50

(Continued)

FOREIGN PATENT DOCUMENTS

DE 418191 8/1925
DE 418191 C * 8/1925 ..... F41A 9/66

(Continued)

*Primary Examiner* — John Cooper
(74) *Attorney, Agent, or Firm* — Foley & Lardner LLP

(57) ABSTRACT

A magazine for use in a firearm includes first and second feed lips having folded portions to reinforce the strength of the respective feed lips. In some embodiments, the strength of the feed lips may be further reinforced by applying one or more welds. The feed lips are capable of withstanding greater amounts of force to avoid failure. Accordingly, the disclosed magazine and method for providing the magazine reduce the "spring back" effect present in conventional magazine feed lips. This removes the additional step of having to over-form the feed lips that is performed when forming a magazine having conventional feed lips. The result is a method for providing a magazine with folded feed lips that are capable of withstanding greater amounts of force to avoid warping, deforming, or other failure, wherein the method for forming the magazine is more accurate, more consistent, and involves fewer steps.

16 Claims, 18 Drawing Sheets

(56) References Cited

U.S. PATENT DOCUMENTS

| | | | | | |
|---|---|---|---|---|---|
| 3,399,480 | A | | 9/1968 | Rowe, Jr. | |
| 3,453,762 | A | * | 7/1969 | Fremont | F41A 9/67 206/3 |
| 3,516,189 | A | * | 6/1970 | Badali | F41A 9/70 42/50 |
| 3,711,981 | A | * | 1/1973 | Seecamp | F41A 9/69 42/50 |
| 3,732,643 | A | | 5/1973 | Wells | |
| 3,854,232 | A | * | 12/1974 | Musgrave | F41A 9/83 42/87 |
| 4,689,907 | A | * | 9/1987 | Gwinn, Jr. | F41A 9/73 42/50 |
| 4,825,744 | A | | 5/1989 | Glock | |
| 4,970,818 | A | * | 11/1990 | Vecchieschi | F41A 9/66 42/50 |
| 5,014,456 | A | * | 5/1991 | Kurtz | F41A 9/65 42/50 |
| 5,168,648 | A | | 12/1992 | Brandl et al. | |
| 5,438,783 | A | * | 8/1995 | Sniezak | F41A 9/65 42/50 |
| 5,615,505 | A | * | 4/1997 | Vaid | F41A 9/61 42/18 |
| 6,952,894 | B1 | * | 10/2005 | Vieweg | F41A 9/65 42/50 |
| 7,318,294 | B2 | | 1/2008 | Zimmermann | |
| 9,772,153 | B1 | * | 9/2017 | Findlay | F41A 9/73 |
| 2010/0101132 | A1 | * | 4/2010 | Jacobson | F41A 9/65 42/50 |
| 2010/0281737 | A1 | | 11/2010 | Cahill | |
| 2012/0124879 | A1 | * | 5/2012 | Larue | F41A 9/70 42/50 |
| 2012/0167428 | A1 | | 7/2012 | Watermann et al. | |
| 2013/0086834 | A1 | * | 4/2013 | Battaglia | F41A 9/65 42/49.02 |

FOREIGN PATENT DOCUMENTS

| | | | | |
|---|---|---|---|---|
| DE | 601941 | | 8/1934 | |
| DE | 601941 C | * | 8/1934 | F41A 9/66 |
| GB | 0 875 222 | | 8/1961 | |
| WO | WO-2008137187 | | 11/2008 | |

* cited by examiner

SYSTEM AND METHOD FOR MAGAZINE WITH FOLDED FEED LIPS

CROSS-REFERENCE TO RELATED APPLICATIONS

This application is a division of U.S. patent application Ser. No. 14/991,466 filed Jan. 8, 2016, entitled "System and Method for Magazine with Folded Feed Lips," which is a continuation-in-part of U.S. patent application Ser. No. 14/887,837 filed Oct. 20, 2015, entitled "System and Method for Magazine with Folded Feed Lips," which claims the benefit and priority of U.S. Provisional Patent App. No. 62/170,520, filed Jun. 3, 2015, entitled "System and Method for Magazine with Folded Feed Lips," as well as the benefit and priority of U.S. Provisional Patent App. No. 62/141,746, filed Apr. 1, 2015, entitled "System and Method for Magazine with Folded Feed Lips," all of which is hereby incorporated by reference in their entirety.

FIELD

The present disclosure relates generally to magazines for firearms. More specifically, but not by way of limitation, the present disclosure relates to a system and method for a magazine having folded feed lips.

BACKGROUND

The statements in this section merely provide background information related to the present disclosure and may not constitute prior art.

When inserted in a firearm, a magazine is used to feed ammunition cartridges to the firearm. The magazine includes an opening that is positioned so that the cartridges can be fed from the magazine to the chamber of the firearm while the magazine is inserted into the firearm. In order to enable feeding of the cartridges, the magazine includes a follower, which operates under spring force to bias the cartridges towards the opening in the magazine. The cartridges and follower are retained in the magazine by feed lips.

Over time, the magazine may sustain damage causing the feed lips to warp or deform. The damage may be caused, for example, by stress applied by the cartridges and/or follower, or by physical abuse such as, for example, that caused by repeated insertion and removal of the magazine from a firearm. Furthermore, it is common that a pistol or other firearm is fired until empty of rounds, at which time the upper receiver assembly/slide/carrier is often designed to lock back in an "open" position. When the slide is locked in the open position and a rapid and firm reload is made by inserting a fully loaded magazine, the inserted magazine typically engages the over-travel stop, resulting in a sudden and abrupt stop of the magazine assembly. Upon this abrupt stop, the momentum of the cartridges loaded in the inserted magazine is absorbed by the magazine feed lips upon impact, thereby applying significant stress to the magazine feed lips.

In some instances of use, magazines are repeatedly ejected onto the ground, which may include hard surfaces such as rocks or concrete. The impact of the ejected magazine striking the ground results in severe and rapid deformation of the magazine feed lips. This deformation is often exacerbated when the ejected magazines contain unspent cartridges, because the increased weight resulting from the unspent cartridges results in increased momentum/inertia, thereby amplifying the damaging effects suffered by the magazine feed lips upon impact with the ground.

As the feed lips deform, their effectiveness is decreased, which may lead to failure of the magazine. Failure of the magazine can include the inability to retain the follower and/or cartridges, which can have significant consequences, particularly if the magazine is inserted in the firearm during failure. For example, failure of the magazine can cause the firearm to misfire, fail to feed, or incur some other malfunction. As such, magazines and, more specifically, magazines with feed lips have not been suitable for all conditions of operation.

SUMMARY

In one embodiment, the present disclosure provides a magazine for use in a firearm, the magazine comprising: a housing having an opening and operable to retain one or more cartridges in an interior portion of the magazine; a first feed lip coupled to the housing at the opening of the housing, wherein the first feed lip includes a first folded portion, wherein the first feed lip is folded toward the interior portion of the magazine and operable, in combination with a second feed lip, to retain the one or more cartridges in the magazine; the second feed lip coupled to the housing at the opening of the housing, wherein the second feed lip includes a second folded portion, wherein the second feed lip is folded toward the interior portion of the magazine and operable, in combination with the first feed lip, to retain the one or more cartridges in the magazine; and a follower disposed in the interior portion of the magazine and operable to bias the one or more cartridges towards the opening of the housing.

In another embodiment, the present disclosure provides a magazine for use in a firearm, the magazine comprising: a housing defining an interior portion of the magazine for housing at least one of a follower and one or more cartridges; a first feed lip coupled to the housing, wherein the first feed lip includes a first folded portion and is operable to retain the at least one of the follower and one or more cartridges in the magazine; and a second feed lip coupled to the housing, wherein the second feed lip includes a second folded portion and is operable to retain the at least one of the follower and one or more cartridges in the magazine.

In yet another embodiment, the present disclosure provides a method for providing a magazine for use in a firearm, the method comprising: forming a housing having an open interior portion for housing at least one of a follower and one or more cartridges, and having an opening for receiving or dispensing the one or more cartridges; forming a first feed lip at the opening of the housing, wherein forming the first feed lip includes providing a first folded portion of the first feed lip; and forming a second feed lip at the opening of the housing, wherein forming the second feed lip includes providing a second folded portion of the second feed lip.

In another embodiment, the present disclosure provides a cartridge retention system for use in a magazine, the cartridge retention system comprising: a housing having an opening and operable to retain one or more cartridges in an interior portion of the magazine; a first feed lip coupled to the housing at the opening of the housing, wherein the first feed lip includes a first folded portion, wherein the first feed lip is folded toward the interior portion of the magazine and operable to retain the one or more cartridges in the magazine at desired lateral and vertical positions; a second feed lip coupled to the housing at the opening of the housing, wherein the second feed lip includes a second folded portion, wherein the second feed lip is folded toward the interior portion of the magazine and operable to retain the one or more cartridges in the magazine at the desired lateral and vertical positions; and a follower disposed in the interior portion of the magazine and operable to bias the one or more cartridges towards the opening of the housing, the follower comprising an engagement member having one or more protrusions operable to engage an annular recess of one of the cartridges to retain the engaged cartridge at a desired horizontal alignment.

In yet another embodiment, a kit for retrofitting an existing magazine may include a new or reformed magazine body, having folded feed lips of the present disclosure, for use with existing magazine baseplates, biasing mechanisms, such as magazine springs, and magazine followers.

Further embodiments and apparatuses, including other areas of applicability, will become apparent from the description provided herein. It should be understood that the description and specific examples are intended for purposes of illustration only and are not intended to limit the scope of the present disclosure in any manner.

BRIEF DESCRIPTION OF THE DRAWINGS

For a more complete understanding of various embodiments of the present disclosure and the advantages thereof, reference is now made to the following brief description, taken in connection with the accompanying drawings and detailed description, wherein like reference numerals represent like parts, and in which.

DETAILED DESCRIPTION OF THE DRAWINGS

In the following detailed description and accompanying drawings, numerous specific details are set forth to provide a thorough understanding of the present disclosure. However, those skilled in the art will appreciate that the present disclosure may be practiced, in some instances, without such specific details. In other instances, well-known elements have been illustrated in schematic or block diagram form in order not to obscure the present disclosure in unnecessary detail. Additionally, for the most part, specific details, and the like, have been omitted inasmuch as such details are not considered necessary to obtain a complete understanding of the present disclosure, and are considered to be within the purview of persons of ordinary skill in the relevant art.

Figure 1A:
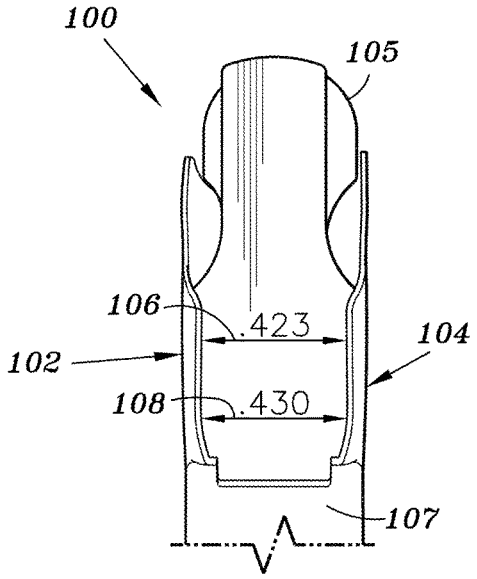
FIGS. 1A, 1B, and 1C each illustrate one of three conventional magazines with deformed feed lips.

Conventional magazines are susceptible to damage that causes their feed lips to warp or deform. For example, FIGS. 1A, 1B, and 1C each illustrate one of three conventional magazines with deformed feed lips, wherein the deformation of the feed lips is characterized by improper spacing between the feed lips of each magazine. In FIG. 1A, magazine 100 includes first feed lip 102 and second feed lip 104, wherein the spacing between the first feed lip 102 and the second feed lip 104 is 0.423 inches at a first location 106 toward the front 105 of the magazine 100, and 0.430 inches at a second location 108 toward the back 107 of the magazine 100. Similarly, in FIG. 1B, magazine 110, having first feed lip 112 and second feed lip 114, has a spacing of 0.423 inches between the first feed lip 112 and the second feed lip 114 at a first location 116 toward the front 115 of the magazine 110, and 0.425 inches at a second location 118 toward the back 117 of the magazine 110. Finally, in FIG. 1C, magazine 120 also has inconsistent spacing between the first feed lip 122 and second feed lip 124. At a first location 126 toward the front 125 of the magazine 120, the spacing between the first feed lip 122 and the second feed lip 124 is 0.403 inches. At a second location 128 toward the back 127 of the magazine 120, the spacing between the first feed lip 122 and the second feed lip 124 is 0.411 inches.

Figure 1B:
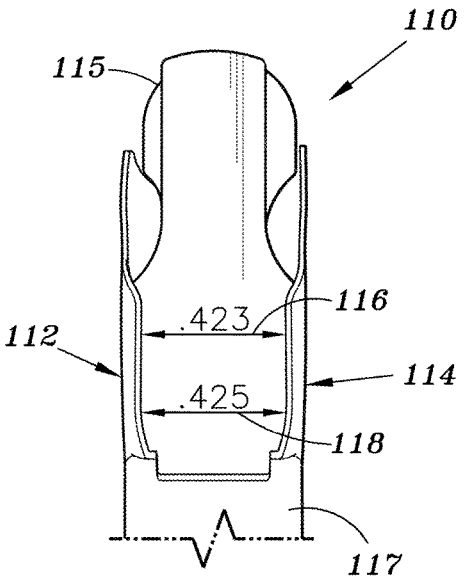
Figure 1C:
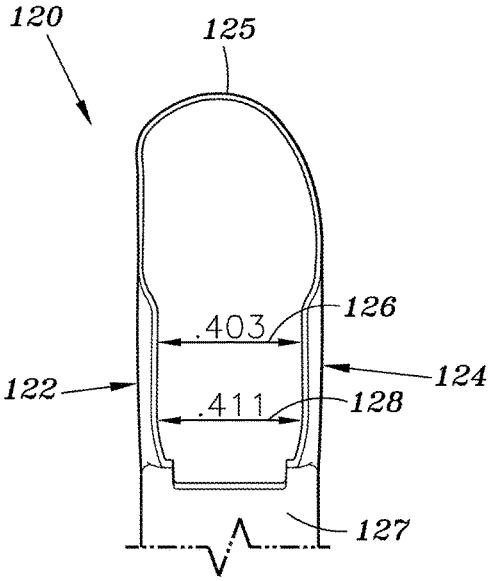

In the example embodiments illustrated in FIGS. 1A, 1B, and 1C, the magazines are formed to have a spacing of approximately 0.384 inches at the first locations toward the fronts of the respective magazines, and a spacing of approximately 0.379 inches at the second locations toward the backs of the respective magazines. As such, FIGS. 1A, 1B, and 1C illustrates deformed or warped feed lips that have inconsistent spacing between the respective feed lips. Additionally, the spacing between the feed lips in FIGS. 1A, 1B, and 1C may be greater than the proper spacing for operation of each of the magazines. The improper and inconsistent spacing may result in failure of the magazines causing the magazines to no longer retain their respective followers or any inserted cartridges, or causing loaded cartridges to sit improperly in the magazines such that the cartridges are unable to properly feed from the magazines into the chamber of a firearm.

Figure 2:
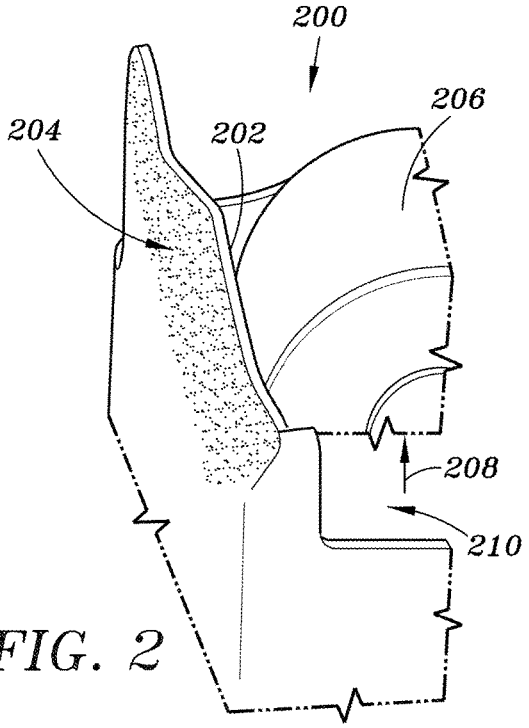
FIG. 2 illustrates a schematic, cutaway view of a conventional magazine.

Referring now to FIG. 2, a cutaway view of a conventional magazine 200 having feed lips 202 is shown in schematic form. The illustration shown in FIG. 2 is provided to demonstrate an approximate location of stress (illustrated by shading 204) experienced by the feed lips 202 of a conventional magazine 200 when a cartridge 206 (shown in a quartered view) is biased against the feed lips 202 in a vertical direction indicated generally by arrow 208. As the number of cartridges 206 loaded in the magazine 200 increases, the spring of the follower is further compressed, thereby increasing the stress applied to the feed lips 202. As discussed above and shown in FIG. 1, the stress experienced by the feed lips 202 can result in deformation or warping of the feed lips 202, which may result in failure of the magazine 200. For example, in the embodiment illustrated in FIG. 2, the stress causes the feed lips 202 to deform in a direction away from the interior 210 of the magazine 200.

It should be appreciated that the feed lips 202 of the magazine 200 may be deformed by other stresses applied to the magazine 200. Moreover, other stresses may cause the feed lips 202 to deform in a direction toward the interior 210 of the magazine 200. For example, repeated physical contact of the magazine feed lips 202 with a firearm during insertion or removal of the magazine 200 from the firearm may cause the feed lips 202 to deform in other directions. Deformation of the feed lips 202 from insertion of the magazine 200 into the firearm not only occurs from the magazine's feed lips 202 making forceful contact with the slide or operating bolt of the firearm in the closed and/or locked position, but can also occur from the magazine 200 being forcefully inserted into the firearm when the firearm's slide or operating bolt is open thereby causing the magazine 200 to be engaged by the firearm's overtravel magazine stop causing the feed lips to absorb the inertial forces of the cartridges being thrust upward into the magazine's feed lips 202 as the magazine's 200 travel is suddenly stopped in the firearm. By way of further example, operators of magazine fed firearms, such as military, law enforcement, and civilian competition shooters, routinely eject empty or partially empty magazines from their firearms allowing the magazines to fall from the firearms directly onto the ground or other hard surface, such as concrete, which can cause severe and rapid deformation of the feed lips 202 of the subject magazine 200, especially when partially loaded magazines are ejected, as the additional weight/momentum of the unfired cartridges enhances the impact forces of the magazine's 200 feed lips 202 with the ground. Any such deformation may cause loaded cartridges to sit improperly in the magazine such that the cartridges are unable to properly feed from the magazine into the chamber of a firearm.

In addition to the foregoing, conventional feed lips, when formed, are susceptible to a "spring back" effect, whereby the feed lips, upon formation, migrate from an initial formed position to a final formed position due to an intrinsic bias of the material used to form the feed lips. In anticipation of this effect of the formation process, conventional feed lips are typically over-formed in the direction opposite the bias of the material in an effort to achieve an acceptable final formed position of the feed lips. Unfortunately, this formation process is often inaccurate as tolerances of the material comprising the feed lips may vary from batch to batch. As such, magazines having conventional feed lips formed using this process may have inconsistent spacing and/or undesirable final formed positions.

Figure 3:
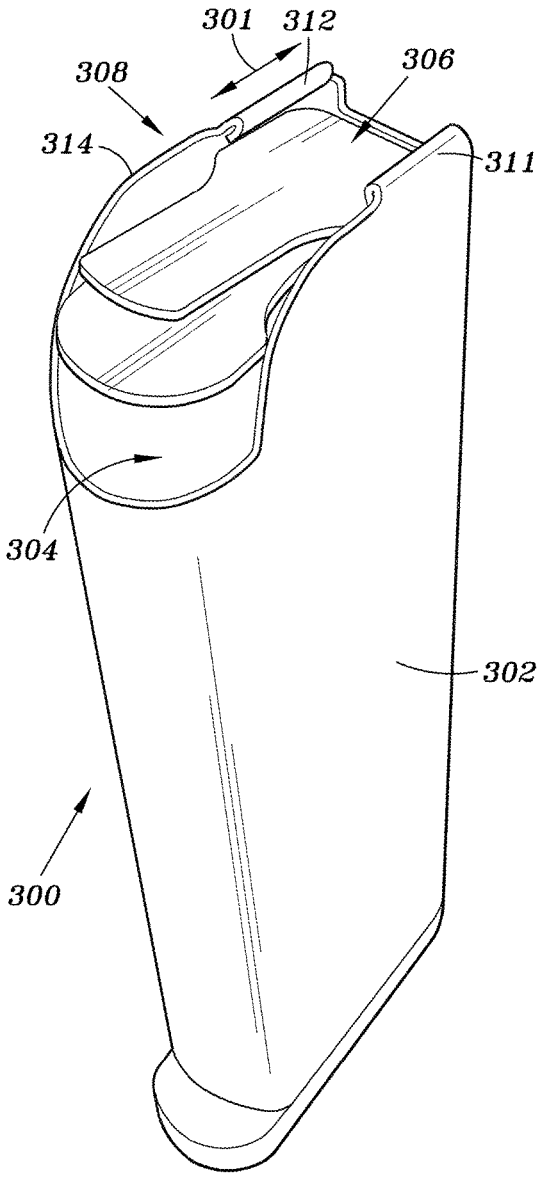
FIG. 3 illustrates a perspective view of an exemplary embodiment of the disclosed magazine having folded feed lips.
Figure 4A:
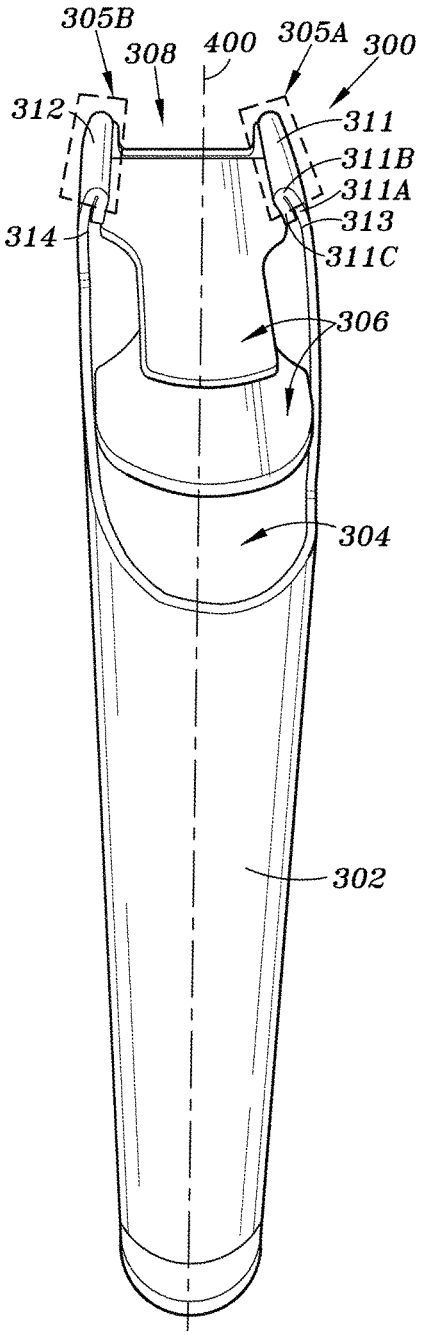
FIGS. 4A and 4B illustrate the magazine of FIG. 3 from front views.
Figure 4B:
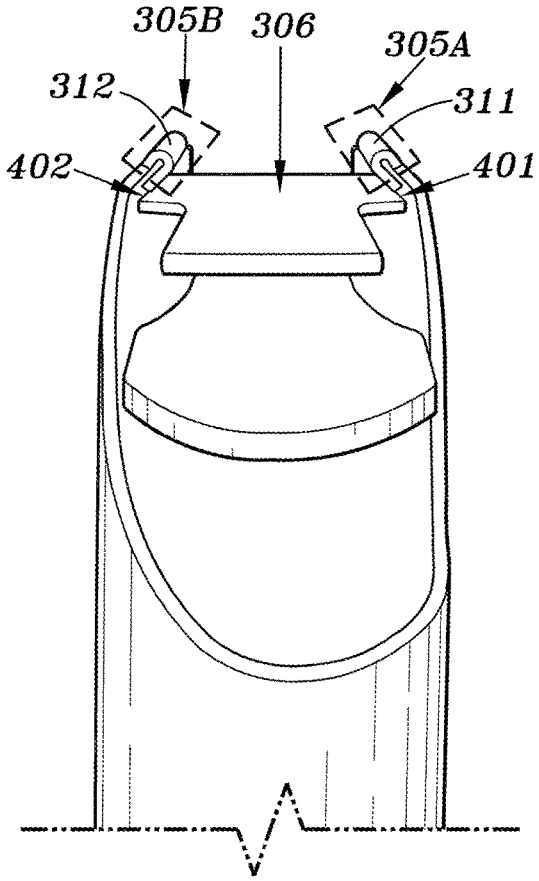

The present disclosure provides a magazine with folded feed lips that reduce, if not eliminate, the foregoing deficiencies present in magazines having conventional feed lips. Referring now to FIGS. 3, 4A, and 4B, an example embodiment of a magazine having folded feed lips is shown from various views. The magazine 300 includes a housing 302 formed from stainless steel or any other material known in the art. The housing 302 has an open interior portion 304 that houses a follower 306 and, when the magazine 300 is loaded, ammunition cartridges (shown, for example, in FIGS. 10-14). The housing 302 includes an opening 308 at the top of the magazine 300 for receiving and dispensing cartridges.

At the top of the magazine 300 are a first folded feed lip 311 and a second folded feed lip 312. The first and second folded feed lips 311 and 312 are formed from the housing 302 and are folded to reinforce the strength of the feed lips 311 and 312, thereby reducing substantially, if not eliminating entirely, the tendency of the feed lips 311 and 312 to warp or deform due to the stresses applied by the loaded cartridges and/or follower 306, or by repeated contact with a firearm during installation and/or removal of the magazine 300. In addition, the folded feed lips 311 and 312 reduce the abovementioned "spring back" effect after the feed lips 311 and 312 are formed, providing for more consistent results when forming the feed lips 311 and 312 of the magazine 300.

As shown in FIG. 4A, the folded feed lips 311 and 312 are symmetrical about an axis 400 extending vertically along the center of the magazine 300. Additionally, the folded feed lips 311 and 312 extend horizontally along line 301 (see FIG. 3) generally defining an upper surface of the housing 302. In some embodiments, the feed lips 311 and 312 may be approximately 7/16 inches long, although, it should be appreciated that the folded feed lips 311 and 312 are not limited to this length and may, in fact, be longer or shorter.

The folded feed lips 311 and 312 are each folded toward the interior portion 304 of the magazine 300 to form a first folded portion 305A on the first feed lip 311, and a second folded portion 305B on the second feed lip 312. In some embodiments, as discussed in greater detail below, the first feed lip 311 is folded toward the interior portion 304 in a U-shape such that a point on the first feed lip 311 and a point on a first interior surface 313 of the housing 302 correspond to two points along a circumference of an imaginary circle having a desired radius. Similarly, the second feed lip 312 is, in some embodiments, folded toward the interior portion 304 in a U-shape such that a point on the second feed lip 312 and a point on a second interior surface 314 of the housing 302 correspond to two points along a circumference of an imaginary circle having a desired radius. This positioning (i.e., where two points correspond to points along the circumference of an imaginary circle having a desired radius) is referred to herein as "corresponding to a desired radius." In some embodiments, the first and second feed lips 311 and 312 may be folded such that they retain a loaded cartridge in a desired vertical position within the magazine 300.

As shown, the feed lip 311 is folded toward the interior portion 304 of the magazine 300 such that the first feed lip 311 is comprised of a first leg 311A having a first end coupled to the housing 302 at the opening into the interior portion 304 and a second end coupled to a U-shaped connector portion 311B, and of a second leg 311C having a first end coupled to the U-shaped connector portion and a second end disposed adjacent the first end of the first leg 311A.

As shown more clearly in FIG. 4B, the folded first and second feed lips 311 and 312 engage the follower 306 and retain it in the open interior 304 of the housing 302 when no cartridges are inserted into the magazine 300. Specifically, the follower 306 (or, if loaded, cartridges) contacts the first and second feed lips 311 and 312 at locations 401 and 402 (shown in FIG. 4B for clarity) at the edges of the first and second feed lips 311 and 312, respectively. Surprisingly, when the force exerted by the follower 306 (and cartridges) is received at the feed lips 311 and 312, the force is unexpectedly redistributed in such a way that the magazine 300 and folded magazine feed lips 311 and 312 are more reliable and robust (in comparison to a magazine having conventional feed lips), and not in a manner that causes the warping and deformation observed when there is no folded portion 305A/305B in each of the feed lips.

Figure 5A:
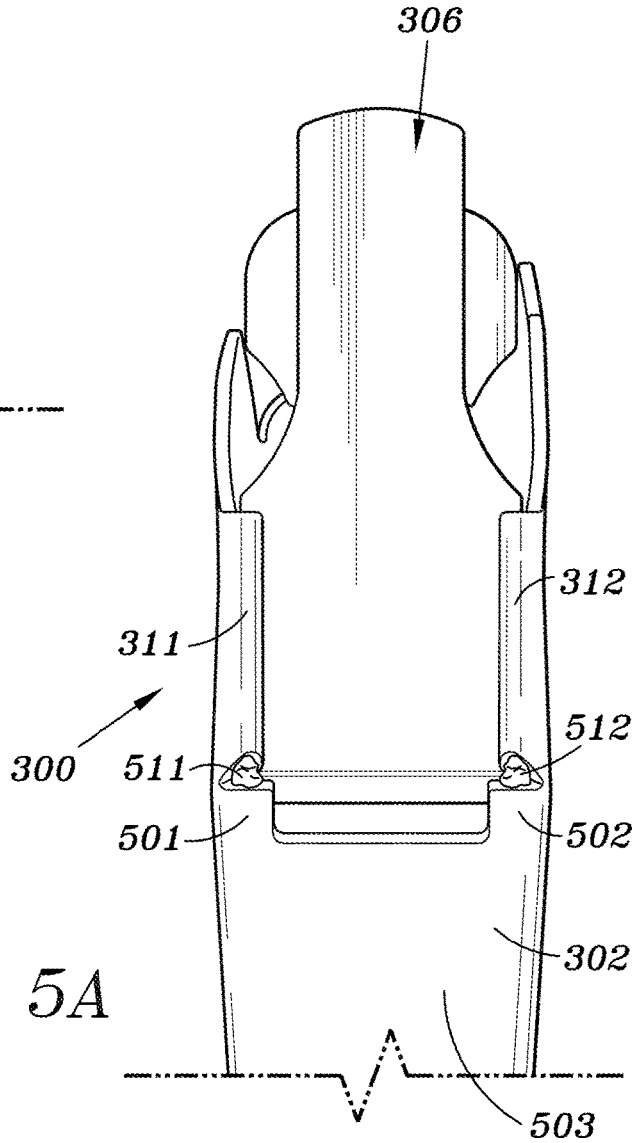
FIGS. 5A, 5B, and 5C illustrate an embodiment wherein the magazine of FIG. 3 includes welds placed between the feed lips and tabs formed on the back side of the magazine housing.
Figure 5B:
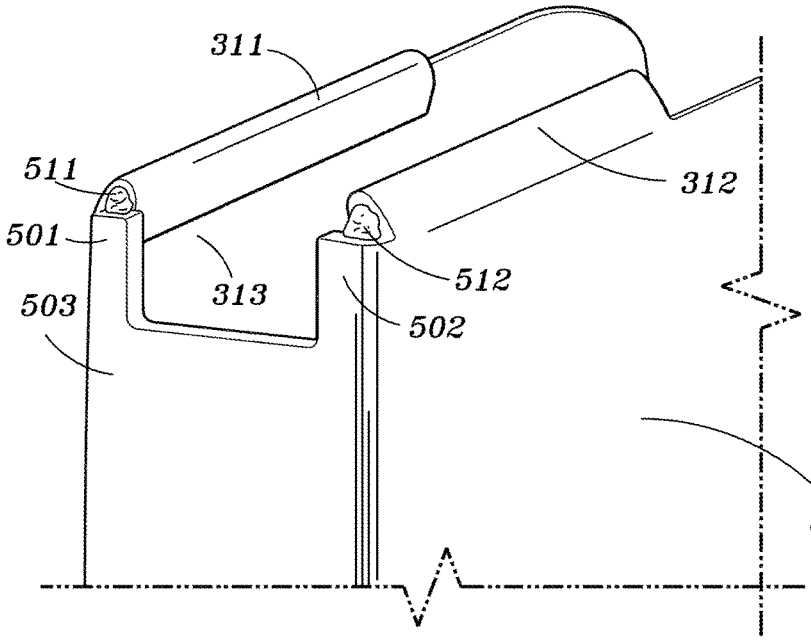
Figure 5C:
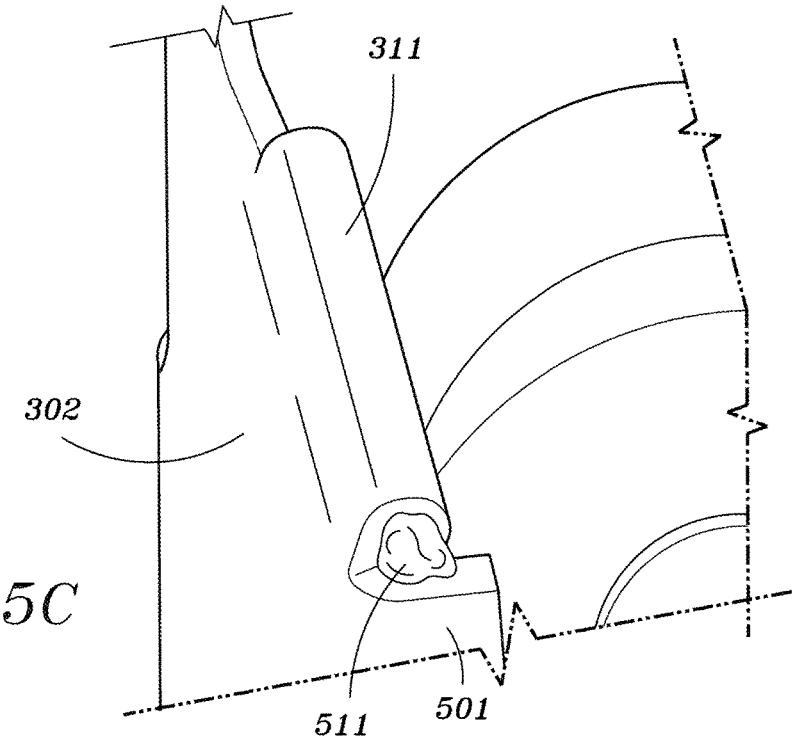
Figure 6:
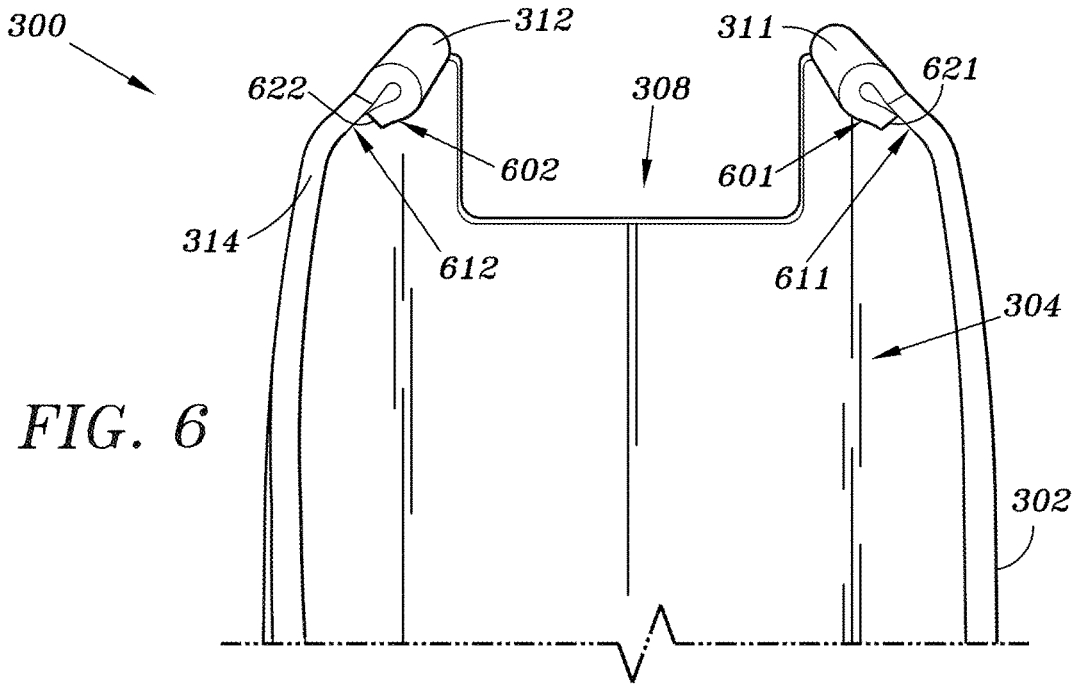
FIG. 6 illustrates the magazine of FIG. 3 from a front view and without the follower installed.
Figure 7:
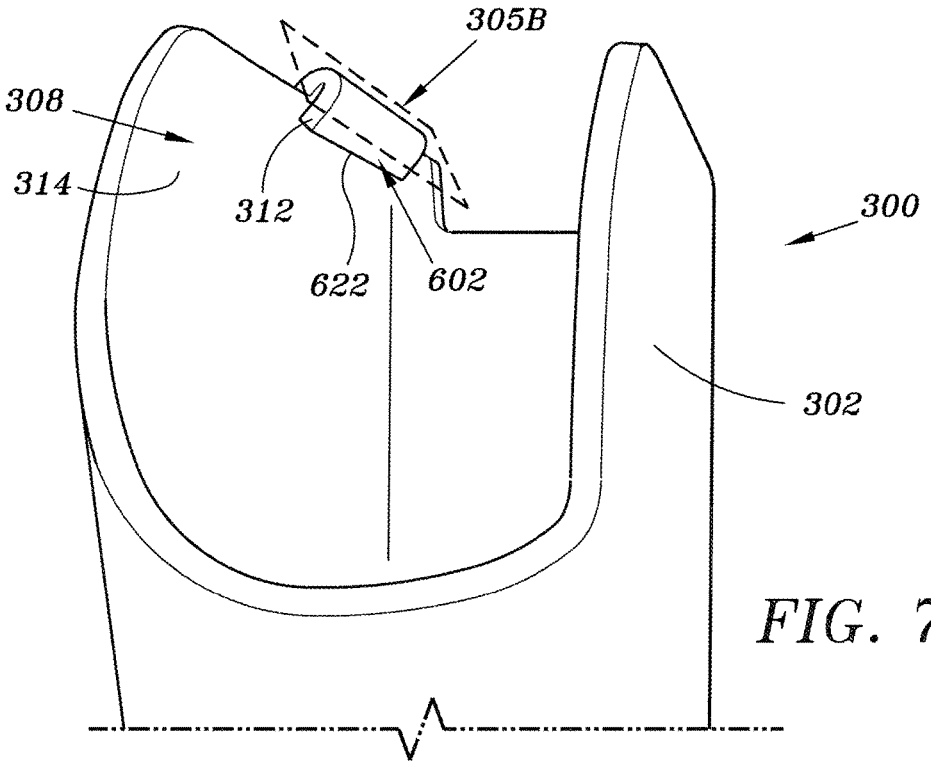
FIG. 7 illustrates a view of the magazine of FIG. 3 without the follower installed.
Figure 8:
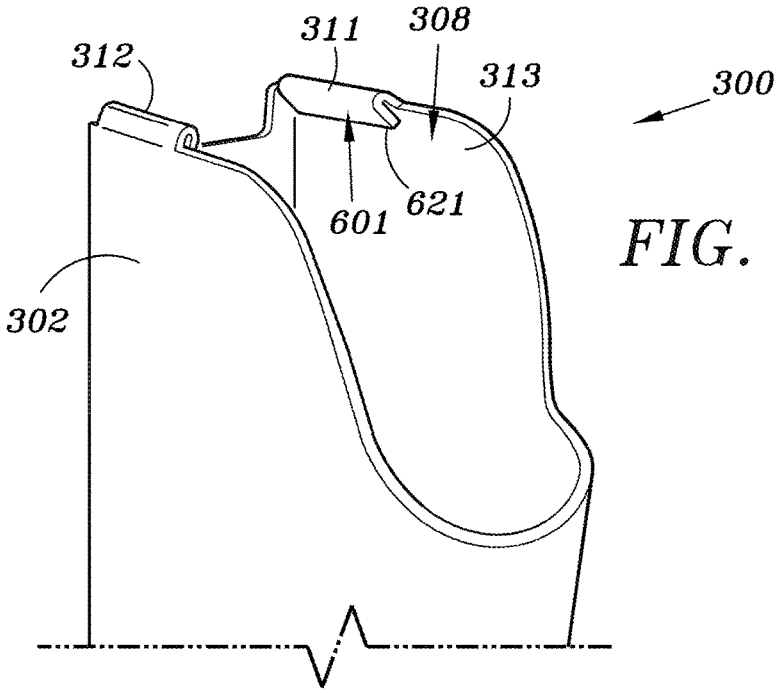
FIG. 8 illustrates a perspective view of the magazine of FIG. 3 without the follower installed.

FIGS. 5A-5C illustrate an embodiment of the magazine 300 having welds placed between the feed lips and tabs formed on the back side of the magazine housing. FIG. 5A illustrates the magazine 300 with the follower 306, FIG. 5B illustrates the magazine 300 without the follower 306, and FIG. 5C illustrates a cutaway schematic view of the magazine 300 to illustrate the weld placed between the first feed lip 311 and first tab formed on the housing 302.

As illustrated in FIGS. 5A and 5B, the housing 302 may, in some embodiments, include tabs 501 and 502 formed on a back side 503 of the housing 302. The first tab 501 is formed adjacent the first feed lip 311, and the second tab 502 is formed adjacent the second feed lip 312. In some embodiments, the magazine 300 may include a first weld 511 placed between the first feed lip 311 and the first tab 501, and a second weld 512 placed between the second feed lip 312 and the second tab 502. In some embodiments, the welds 511 and 512 may also connect to the first and second interior surfaces 313 and 314, respectively, of the housing 302. The welds 511 and 512 are implemented to reinforce the strength of the first and second feed lips 311 and 312, respectively, by bonding the first feed lip 311 to the first tab 501 (and, in some embodiments, interior surface 313) and bonding the second feed lip 312 to the second tab 502 (and, in some embodiments, interior surface 314). Accordingly, the welds and tabs each act to further reinforce the strength of the folded feed lips because stress applied to the folded feed lips is also disbursed along the welds, tabs, and housing.

FIGS. 6-9 illustrate the magazine 300 with the follower 306 removed to more clearly illustrate various features of the magazine 300. In the embodiment illustrated in FIGS. 6-8, the first feed lip 311 is folded such that a point 601 on the first feed lip 311 and a point 611 (approximately shown) on the first interior surface 313 each contact a loaded cartridge (not shown) and correspond to a desired radius. Similarly, the second feed lip 312 is folded such that a point 602 on the second feed lip 312 and a point 612 (approximately shown) on the second interior surface 314 each contact a loaded cartridge (not shown) and correspond to a desired radius. In some embodiments, the first and second feed lips 311 and 312 may be folded such that they retain a loaded cartridge in a desired vertical position within the magazine 300.

Figure 9:
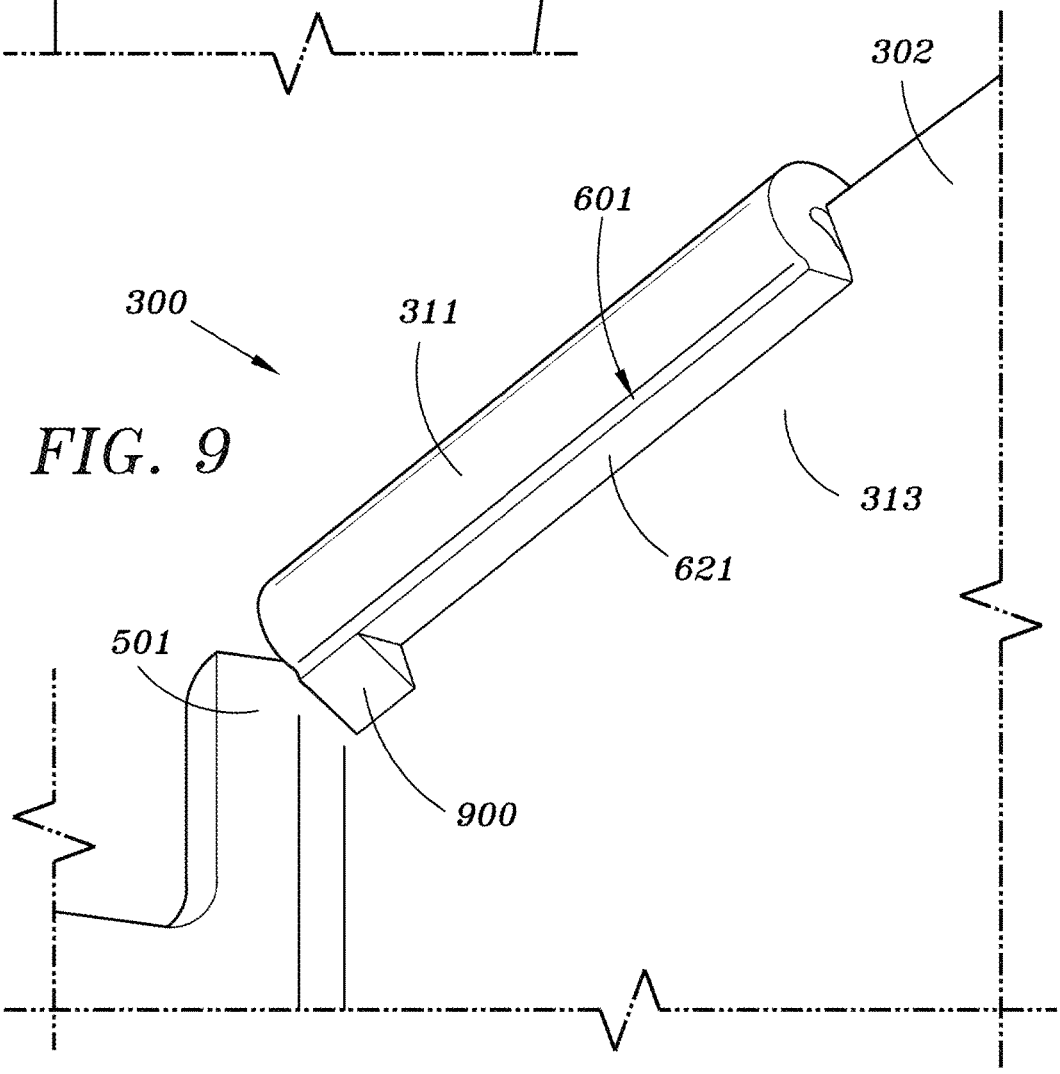
FIG. 9 illustrates a schematic view of the magazine of FIG. 3 having a weld placed along the end of the first folded feed lip to bond the first feed lip to the first interior surface of the housing.

In some embodiments, a weld may be added along an edge 621 of the first feed lip 311 and/or along an edge 622 of the second feed lip 312. For example, FIG. 9 illustrates an embodiment wherein the magazine 300 includes a weld 900 placed along the edge 621 of the first folded feed lip 311 to bond the first feed lip 311 to the first interior surface 313 of the housing 302. In some embodiments, the weld 900 may be placed along a portion of the edge of the feed lip (as shown in FIG. 9), or the weld 900 may be placed along the entirety of the edge of the feed lip. In the embodiment illustrated in FIG. 9, the weld 900 acts to reinforce the strength of the folded feed lip 311 because stress applied to the folded feed lip 311 is also disbursed along the weld 900 and housing 302.

Referring now to FIGS. 10-14, the magazine 300 of FIG. 3 is shown with ammunition cartridges 1000 loaded in the magazine 300. The folded first and second feed lips 311 and 312 engage the top cartridge 1000 (i.e., the cartridge 1000 positioned at the top of the magazine 300) to retain the cartridge 1000, any additional cartridges, and the follower 306 in the open interior portion 304 of the magazine housing 302. The feed lips 311 and 312 retain the cartridges 1000 in position during loading of the magazine 300, and also position the cartridges 1000 so that they may be dispensed from the magazine 300 into the chamber of a firearm.

As discussed above, the strength of the feed lips 311 and 312 is reinforced by their folded geometry (and, in some embodiments, by welds) so that the feed lips 311 and 312 are able to withstand the physical stresses applied by the cartridges 1000 and follower 306, even as additional cartridges 1000 are loaded into the magazine 300. As shown more clearly in FIG. 13, the folded first and second feed lips 311 and 312 engage the upper-most cartridge 1000(*a*) and retain it (along with additional cartridges 1000 and the follower 306) in the open interior 304 of the housing 302. Specifically, the cartridge 1000(*a*) contacts the first and second feed lips 311 and 312 at locations 1301 and 1302 extending along the first and second feed lips 311 and 312, respectively. Surprisingly, when the force exerted by the cartridges 1000 and follower 306 is received at the feed lips 311 and 312, the force is unexpectedly redistributed in such a way that the magazine 300 and folded magazine feed lips 311 and 312 are more reliable and robust (in comparison to a magazine having conventional feed lips), and not in a manner that causes the warping and deformation observed when there is no folded portion 305A/305B in each of the feed lips. Thus, the folded feed lips 311 and 312 are able to withstand such stresses (and stresses resulting from physical contact with the firearm during insertion and/or removal of the magazine 300) without warping or deforming.

Figure 10:
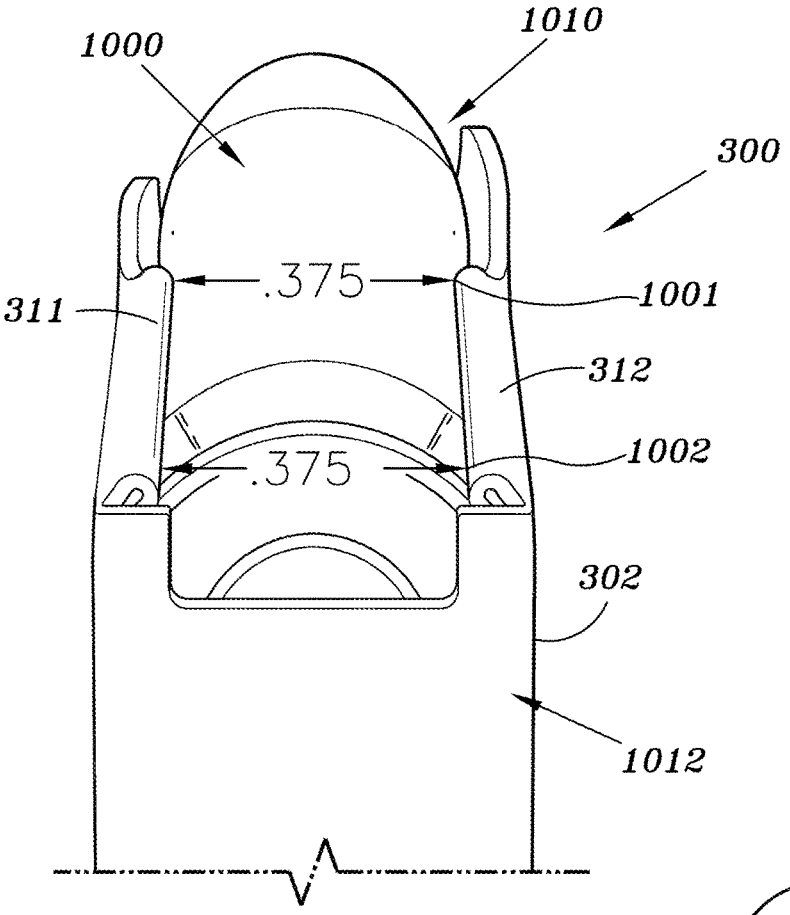
FIG. 10 illustrates a rear view of the magazine of FIG. 3 with cartridges loaded into the magazine.
Figure 11:
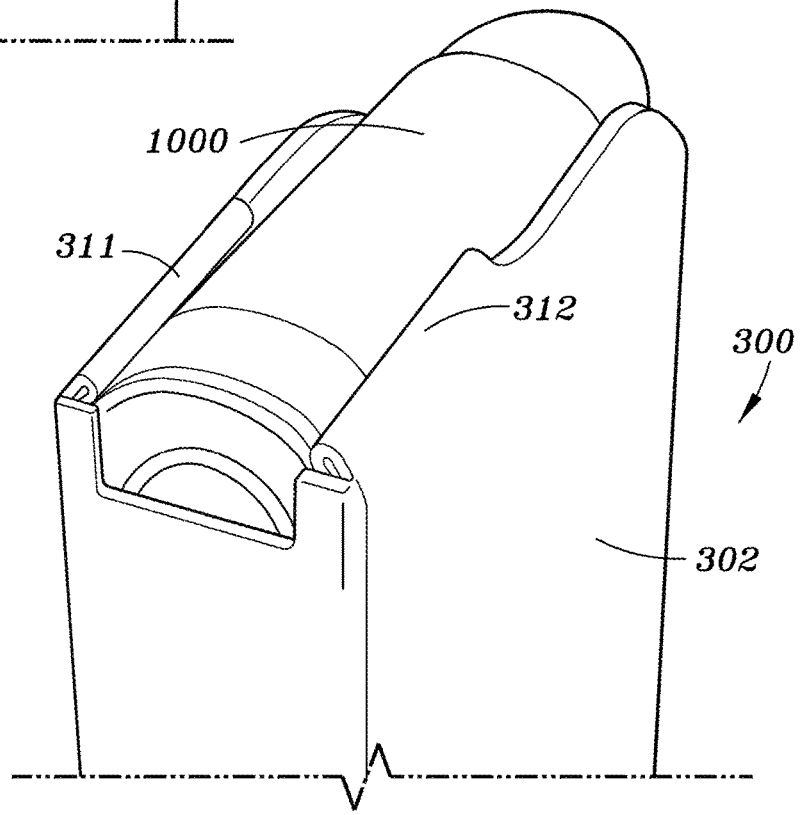
FIG. 11 illustrates a perspective view of the magazine of FIG. 3 with cartridges loaded into the magazine.
Figure 12:
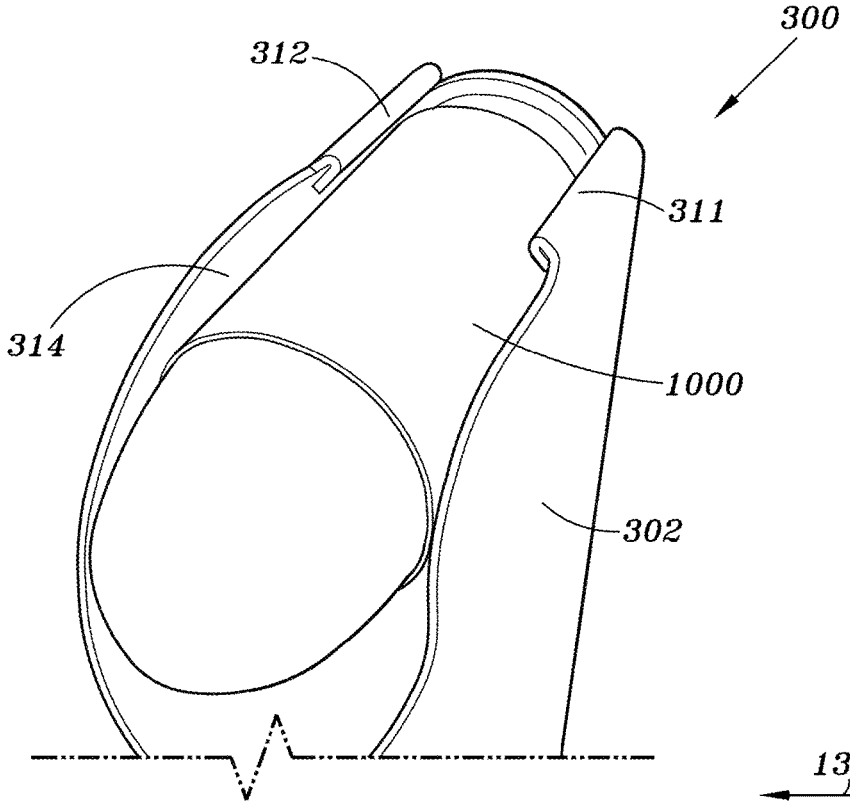
FIG. 12 illustrates a perspective view of the magazine of FIG. 3 with cartridges loaded into the magazine.

For example, FIG. 10 illustrates a spacing of approximately 0.375 inches between the feed lips 311 and 312 at a first location 1001 toward the front 1010 of the magazine 300, and a spacing of approximately 0.375 inches at a second location 1002 toward the back 1012 of the magazine 300. The spacing of the feed lips 311 and 312 in FIG. 10 is consistent.

Figure 15:
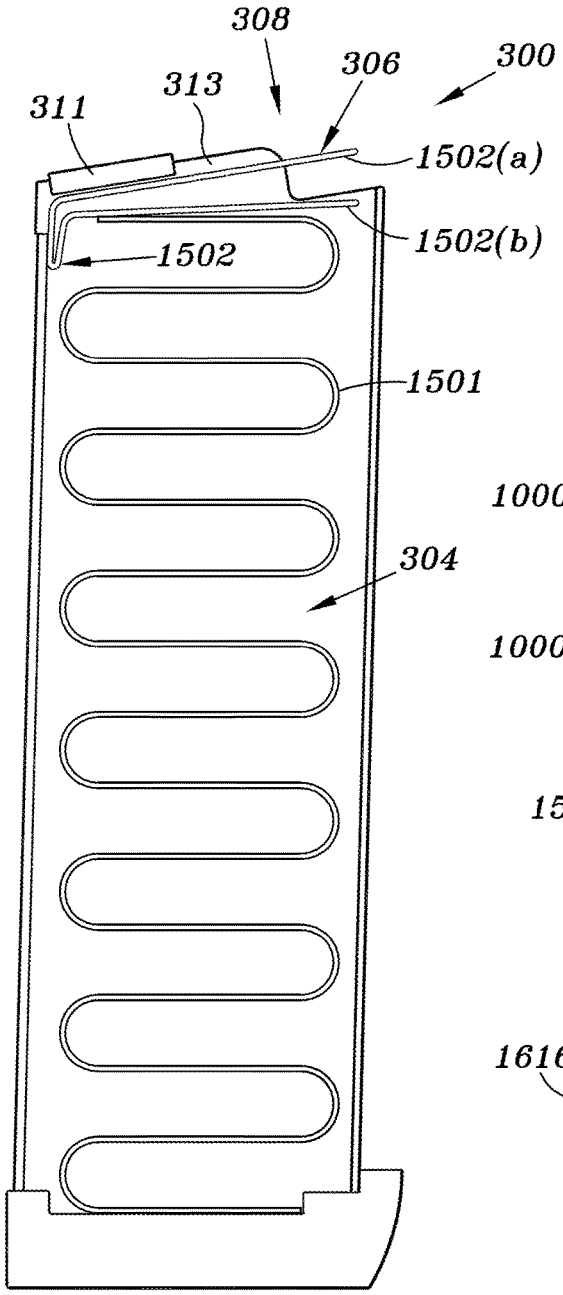
FIG. 15 illustrates the magazine of FIG. 3 with half of the housing removed to show the follower and open interior portion of the empty magazine.
Figure 16:
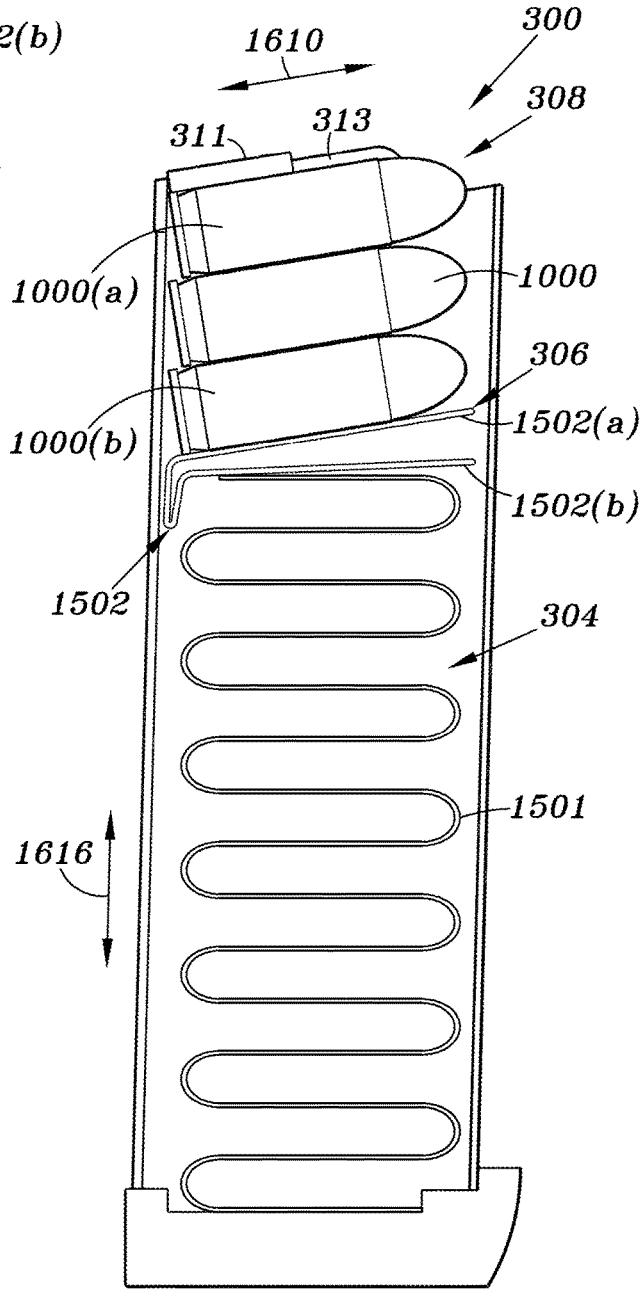
FIG. 16 illustrates the magazine of FIG. 3 with half of the housing removed to show the follower and open interior portion of the magazine loaded with cartridges.

Referring now to FIGS. 15 and 16, the magazine 300 is illustrated with half of the housing 302 removed to show the open interior portion 304 of the magazine 300. FIG. 15 illustrates the magazine 300 having no cartridges loaded, and FIG. 16 illustrates the magazine 300 having cartridges 1000 loaded. The follower 306 is shown comprising a biasing member 1501 and an engagement member 1502. In some embodiments, the biasing member may include a spring, and the engagement member 1502 may include a metal tab or any other structure known in the art for engaging one or more cartridges. Collectively, the biasing member 1501 and engagement member 1502 comprising the follower 306 act to bias the cartridges 1000 toward the opening 308 at the top of the magazine 300 so that the cartridges 1000 are capable of being dispensed from the magazine 300.

When the magazine 300 is empty, as shown in FIG. 15, the first feed lip 311 and second feed lip (not shown) engage the engagement member 1502 to retain the engagement member 1502 and biasing member 1501 in the open interior portion 304 of the magazine 300. When the magazine 300 is loaded, as shown in FIG. 16, the first feed lip 311 and second feed lip (not shown) engage the upper-most cartridge 1000 (*a*) to retain the cartridges 1000, engagement member 1502, and biasing member 1501 in the open interior portion 304 of the magazine 300.

As shown in FIG. 16, the engagement member 1502 engages the lower-most cartridge 1000(*b*), and the biasing member 1501 biases the engagement member 1502 and cartridges 1000 toward the opening 308 located at the top of the magazine 300. As cartridges 1000 are loaded into the magazine 300, the biasing member 1501 becomes compressed, causing the biasing member 1501 to exert increased spring force to the engagement member 1502 and feed lips 311 and 312 (not shown). The feed lips 311 and 312 are designed to withstand this increased spring force as discussed herein. It should be appreciated that the follower 306 illustrated in FIGS. 15 and 16 (and any other figures disclosed herein) is exemplary, and may comprise other structure or may be formed in other ways. For example, the engagement member 1502 is shown in FIGS. 15 and 16 as having two arms 1502(*a*) and 1502(*b*). In other embodiments, the engagement member 1502 may have fewer or more arms. It should also be appreciated that the biasing member 1501 is capable of biasing the engagement member 1502 toward the opening 308, even when no cartridges are loaded.

Figure 17:
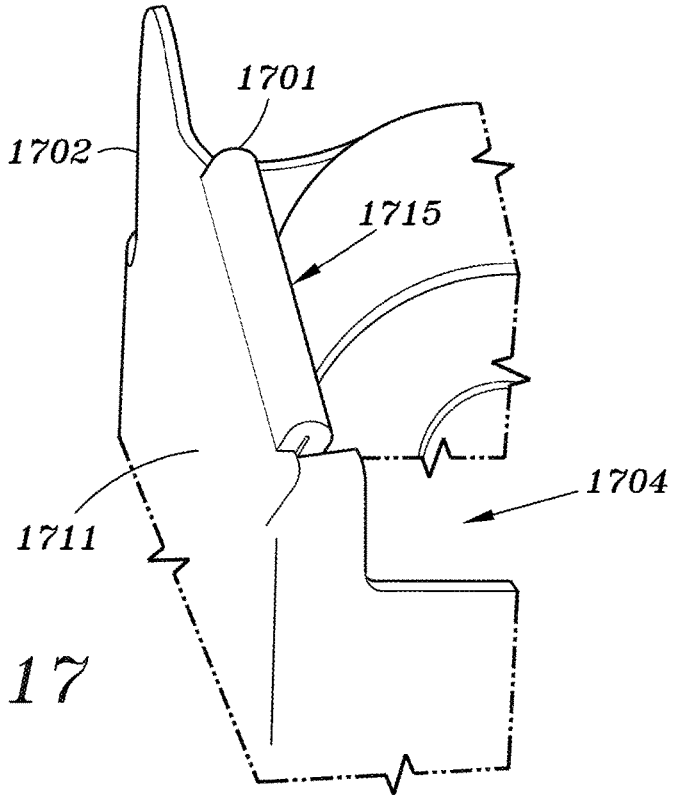
FIG. 17 illustrates a schematic view of an example embodiment of a magazine having feed lips folded away from the interior of the magazine.

Referring now to FIG. 17, an example embodiment of the disclosed magazine is illustrated in a cutaway, schematic view wherein the first feed lip 1701 and second feed lip (not shown) are folded away from the open interior portion 1704 of the housing 1702 and toward an exterior surface 1711 of the housing 1702. In the embodiment shown in FIG. 17, the first feed lip 1701 is folded such that a point (represented generally by 1715) on the first folded feed lip 1701 and a point (not shown) on a first interior surface of the housing 1702 correspond to a desired radius. Although it is not illustrated in FIG. 17, the second feed lip is formed to mirror the first feed lip 1701. Therefore, it should be appreciated that the second feed lip is folded away from the open interior portion 1704 such that a point on the second folded feed lip and a point on a second interior surface of the housing 1702 correspond to a desired radius. In some embodiments, the folded feed lips discussed with respect to FIG. 17 may also include a weld placed adjacent the folded feed lips (e.g., between the folded feed lip and respective exterior or interior surface of the housing 1702). In some embodiments, the first and second feed lips and are folded such that they retain a cartridge in a desired vertical position within the magazine housing 1702.

Figure 18A:
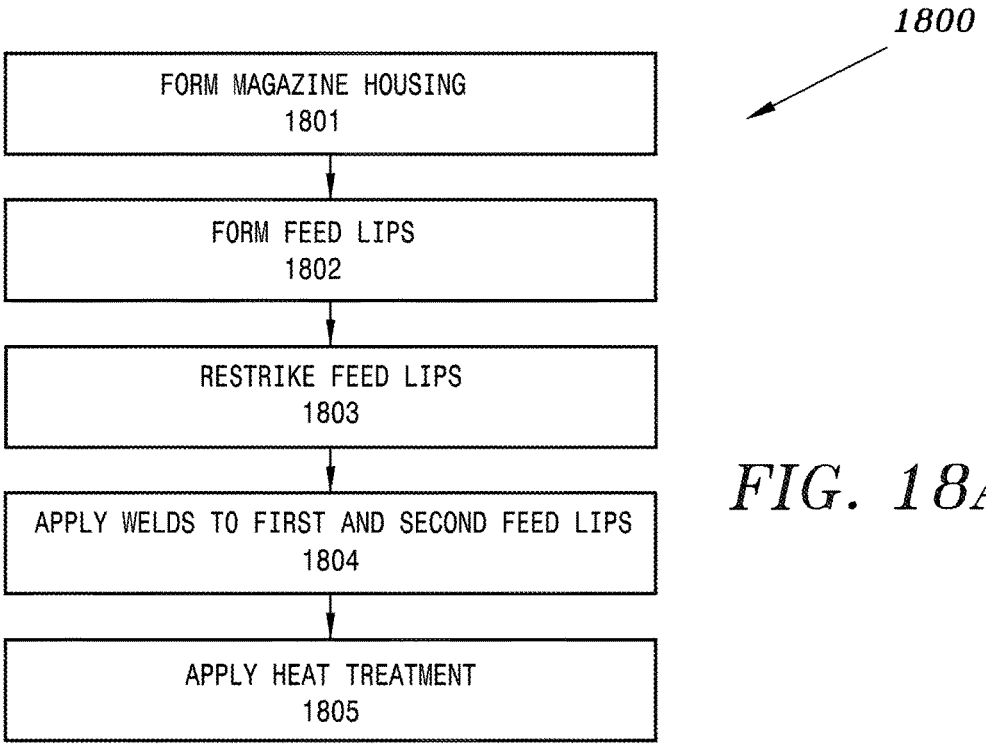
FIG. 18A illustrates a flow chart illustrating a method for forming the magazine having folded feed lips.
Figure 18B:
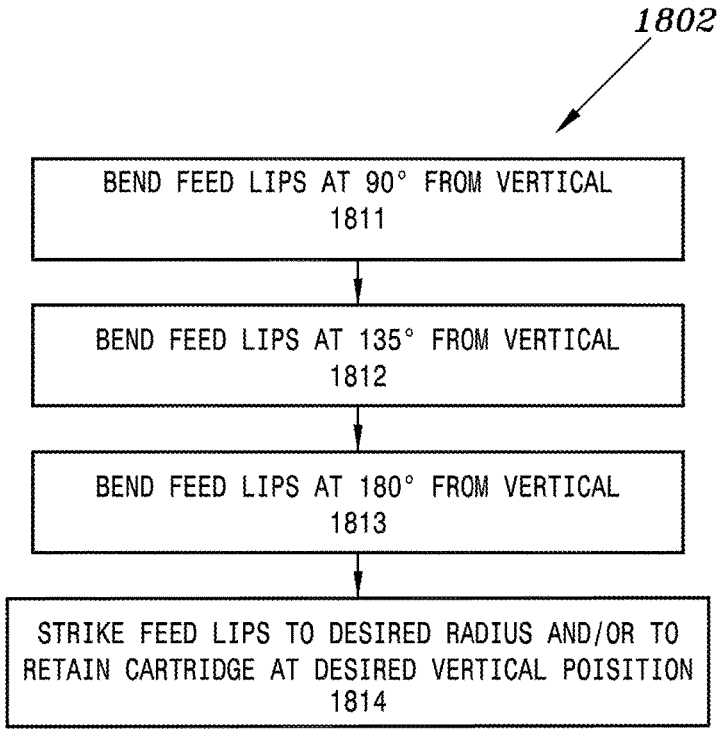
FIG. 18B illustrates a flow chart illustrating a method for forming the folded feed lips.

FIG. 18A illustrates an example flow chart illustrating a method 1800 for forming the magazine having folded feed lips in accordance with the present disclosure. At 1801, a magazine housing is formed having an open interior portion for housing the follower and, when loaded, one or more cartridges, and having an opening for receiving or dispensing the one or more cartridges. In some embodiments, forming the housing includes forming first and second tabs at the rear of the housing and adjacent the opening for receiving or dispensing the one or more cartridges.

At 1802, the first and second feed lips are formed from the housing at the opening of the housing. In some embodiments, forming the first and second feed lips comprises folding the feed lips in a direction toward the open interior of the magazine as discussed in greater detail below. In such embodiments, forming the first and second feed lips may further include folding the feed lips toward the open interior portion of the housing such that a point on the first feed lip and a point on a first interior surface of the housing correspond to a desired radius, and a point on the second feed lip and a point on a second interior surface of the housing correspond to a desired radius. In other embodiments, forming the first and second feed lips comprises folding the feed lips in a direction away from the open interior of the magazine.

Figure 24A:
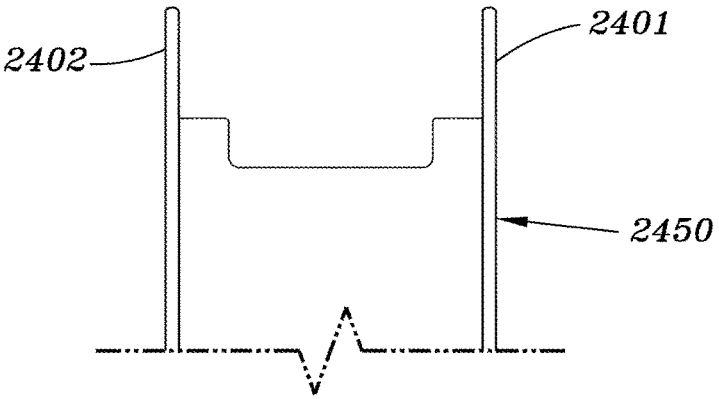
FIGS. 24A-24E illustrate various stages of the process for folding the feed lips.

Reference is briefly made to FIG. 24A, which illustrates the first and second feed lips 2401 and 2402 formed from the housing 2450. When forming the first and second folded feed lips, the feed lips are formed to be longer than conventional feed lips. The long feed lips are then folded over as discussed below.

Figure 24B:
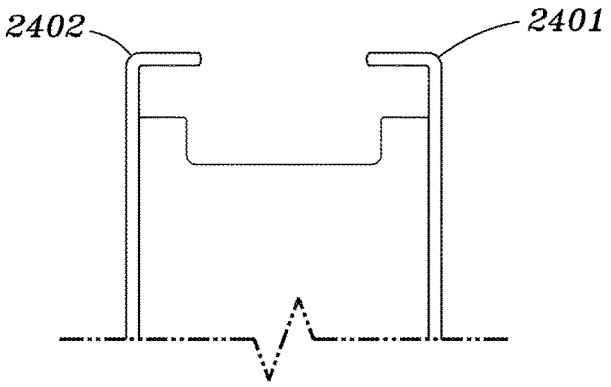
Figure 24C:
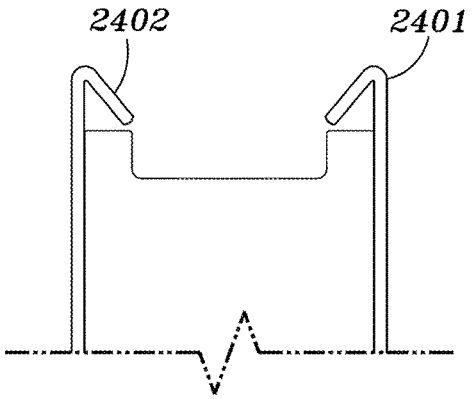
Figure 24D:
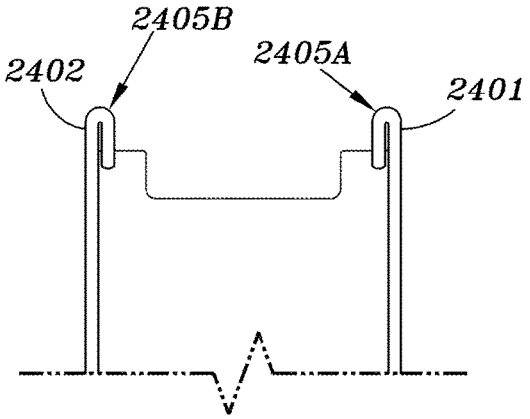
Figure 24E:
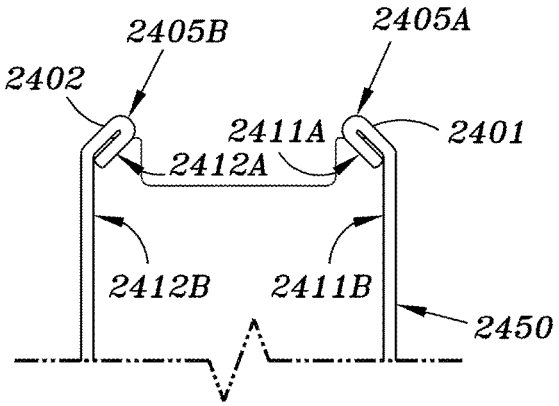

Reference is now made to FIGS. 18B and 24B-24E, which are provided to further illustrate and describe 1802. At 1811 of FIG. 18B, the first and second feed lips 2401 and 2402 are bent (e.g., using a die) such that a portion of the feed lips are positioned approximately 90° from vertical, thereby partially forming folded portions as shown in FIG. 24B. The folded portions are shown as folded portions 2405A and 2405B in FIGS. 24D and 24E. At 1812, the first and second feed lips 2401 and 2402 are bent such that a portion of the feed lips are positioned approximately 135° from vertical, thereby further forming the folded portions as shown in FIG. 24C. At 1813, the first and second feed lips 2401 and 2402 are bent such that a portion of the feed lips are positioned approximately 180° from vertical, thereby completing the folded portions 2405A and 2405B as shown in FIG. 24D. It should be appreciated that the feed lips illustrated in FIGS. 24B-24D correspond to an embodiment where the feed lips are folded toward the interior portion of the magazine 2450. In embodiments in which the feed lips are folded away from the interior of the magazine 2450, the foregoing steps are performed as described except that the feed lips are bent away from the interior of the magazine, rather than toward the interior of the magazine as shown in FIGS. 24B-24D. It should also be appreciated that step 1802 may include fewer or more bends than discussed in connection with FIG. 18B. Also, the feed lips 2401 and 2402 may include, in some embodiments, more folded portions than those shown. In some embodiments, the folded portions may be formed by folding the feed lips at an angle greater than 180° from vertical.

Finally, at 1814, the first and second feed lips 2401 and 2402 are struck (e.g., smashed between a punch and die) so that the feed lips are positioned to correspond to a desired radius and/or such that they are capable of retaining a loaded cartridge in a desired vertical position within the magazine. In the embodiment illustrated in FIG. 24E, the first and second feed lips 2401 and 2402 are each struck to correspond to a radius of 0.260 inches. In other words, a first point 2411A on the first feed lip 2401 contacts a cartridge loaded in the magazine, and a second point 2411B on the housing also contacts the loaded cartridge. The first and second points 2411A and 2411B correspond to two points along the circumference of an imaginary circle having a radius of 0.260 inches. Similarly, a first point 2412A on the second feed lip 2402 contacts the loaded cartridge and a second point 2412B on the housing also contacts the loaded cartridge. The first and second points 2412A and 2412B correspond to two points along the circumference of an imaginary circle having a radius of 0.260 inches. It should be appreciated that the dimensions described above and illustrated in FIG. 24E are one example of a desired radius. Other radii may be desirable depending, typically, upon the caliber of the ammunition for which the magazine is designed, and upon the desired vertical position of the uppermost cartridge loaded into the magazine.

In some embodiments, 1814 includes striking the first and second feed lips 2401 and 2402 such that they are capable of retaining a loaded cartridge in a desired vertical position within the magazine. The vertical position of the loaded cartridge, specifically the uppermost loaded cartridge, is determined by the vertical position of the points 2411A and 2412A that contact the uppermost loaded cartridge. Therefore, the feed lips 2401 and 2402 may be positioned such that the points 2411A and 2412A that contact the uppermost cartridge retain the cartridge at a desired vertical position within the magazine.

Referring again to FIG. 18A, at 1804, a weld is applied to at least one of the first and second feed lips to further reinforce the strength of the respective first and second feed lips. In some embodiments, a first weld is applied between the first feed lip and a first tab located at the rear of the housing and adjacent the opening for receiving or dispensing the one or more cartridges. In some embodiments, this weld may also be connected to the first interior surface of the housing. In other embodiments, the first weld is applied between the first feed lip and the first interior surface of the housing. In some embodiments, a second weld is applied between the second feed lip and a second tab located at the rear of the housing and adjacent the opening for receiving or dispensing the one or more cartridges. In some embodiments, this weld may also be connected to the second interior surface of the housing. In other embodiments, the second weld is applied between the second feed lip and the second interior surface of the housing.

At 1805, a heat treatment is applied to the first and second feed lips. The heat treatment process may include, for example, heating the magazine in an inert atmosphere to 1825° for at least 25 minutes, cooling the magazine to ambient temperature, reheating the magazine to 300° for at least 60 minutes, then air cooling the magazine. The heat treatment improves the rigidity of the magazine, making it less ductile and improving its resistance to abrasion. In some embodiments, the heat treatment seeks to achieve a final hardness of 37-43 on the Rockwell C-Scale.

As discussed herein, folding the first and second feed lips reinforces the strength of the respective feed lips. In some embodiments, the strength of the feed lips may be further reinforced by applying one or more welds. Accordingly, the embodiments discussed herein provide a magazine with folded feed lips that are capable of withstanding greater amounts of force to avoid failure. The disclosed magazine and method for providing the magazine reduce the "spring back" effect present in conventional magazine feed lips. This removes the additional step of having to over-form the feed lips that is performed when forming a magazine having conventional feed lips. The result is a method for providing a magazine with folded feed lips that are capable of withstanding greater amounts of force to avoid warping, deforming, or other failure, wherein the method for forming the magazine is more accurate, more consistent, and involves fewer steps.

In some embodiments, the magazine follower may include one or more protrusions disposed towards the rear of the engagement member and operable to engage an annular recess formed in a cartridge to retain the cartridge in a desired position along the length of the engagement member of the follower. For example, FIGS. 19A-19G illustrate various views of an example embodiment of the engagement member 1901 of the magazine follower having a protrusion 1905.

Figure 19A:
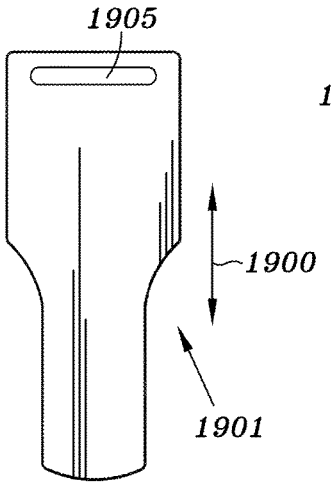
FIGS. 19A-19G illustrate various views of an example embodiment of an engagement member having a protrusion.
Figure 19B:
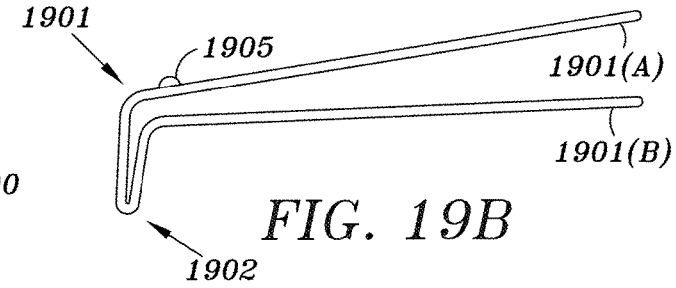
Figure 19C:
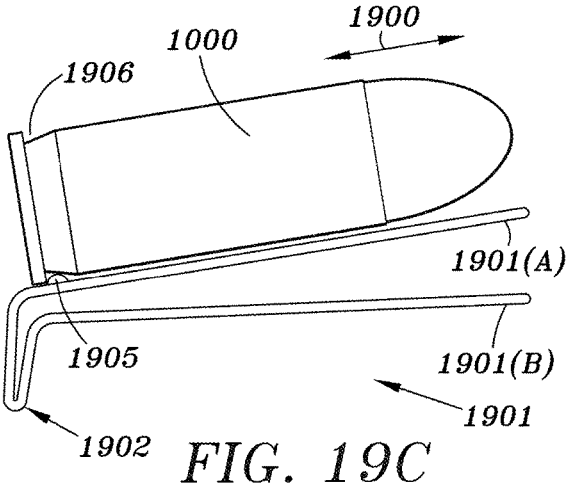
Figure 19D:
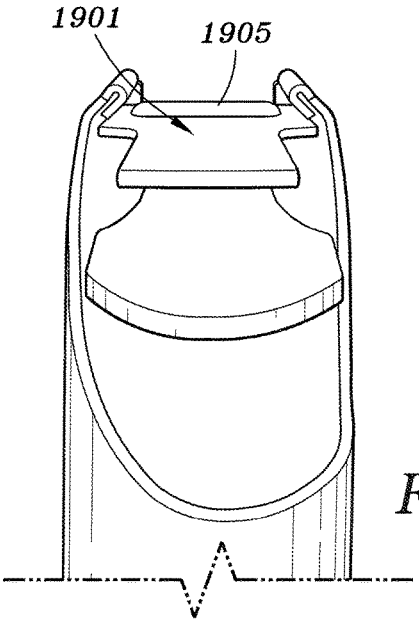
Figure 19E:
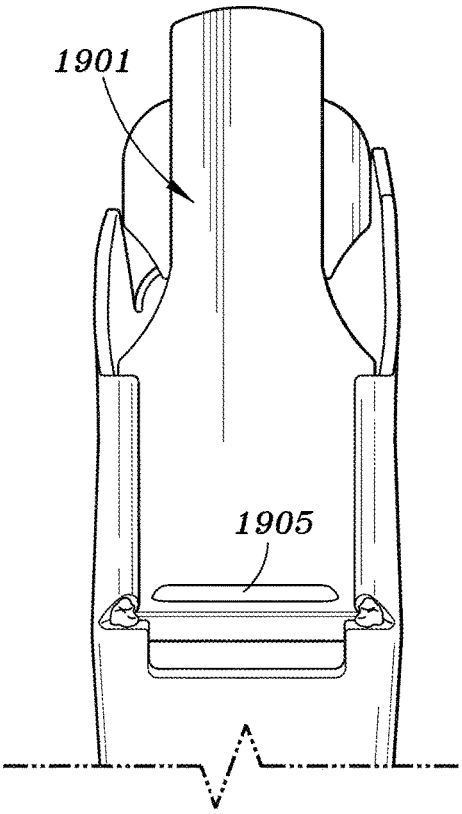
Figure 19G:
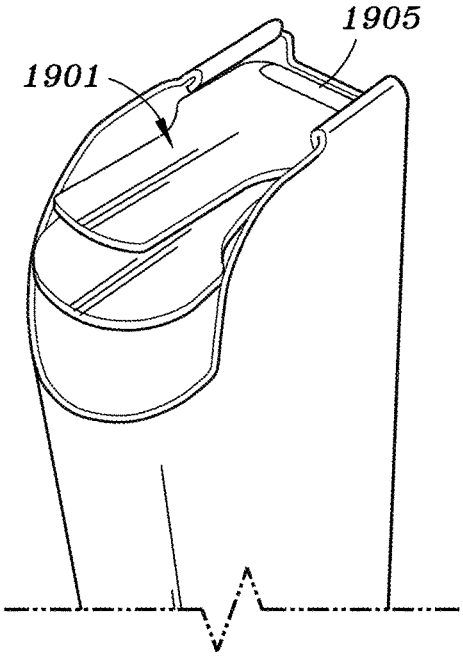
Figure 19F:
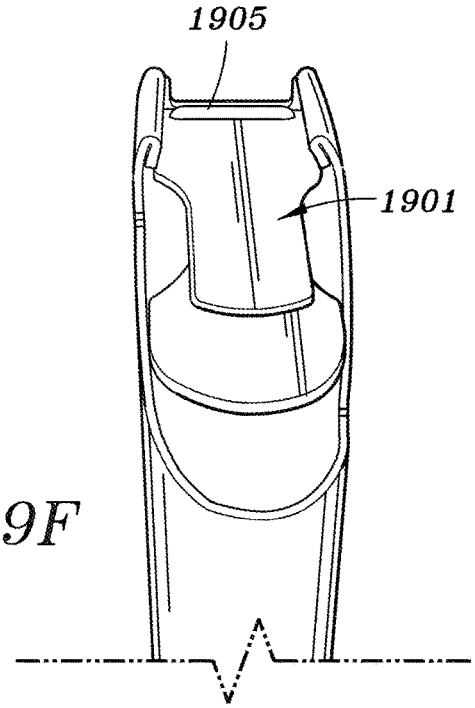

FIG. 19A illustrates an overhead view of the engagement member 1901 and protrusion 1905, and an axis 1900 representative of the direction of the length of the engagement member 1901. FIG. 19B illustrates a profile view of the engagement member 1901 and protrusion 1905. FIG. 19C illustrates a profile view of the engagement member 1901 and protrusion 1905, wherein a cartridge 1000 is shown positioned on the engagement member 1901. The engagement member 1901 is shown from a front-facing view in FIG. 19D, a back-angled view in FIG. 19E, a front-angled view in FIG. 19F, and from a perspective view in FIG. 19G.

As shown in FIG. 19C, the cartridge 1000 includes an annular recess 1906. When the cartridge 1000 is loaded into the magazine, the annular recess 1906 mates with the protrusion 1905 to retain the cartridge 1000, via friction fit, along the length 1900 of the engagement member 1901. The protrusion 1905 is formed on the engagement member 1901 such that the cartridge 1000 is positioned on the engagement member 1901 at a desired location along the length 1900 of the engagement member 1901, thereby providing a horizontal alignment of the cartridge 1000 in the magazine. The horizontal alignment is represented generally by line 1900 in FIGS. 19A and 19C and by line 1610 in FIG. 16.

The protrusion 1905 illustrated in FIGS. 19A-19G comprises a raised bar that is formed from the engagement member 1901 and positioned substantially perpendicular to the length 1900 of the engagement member 1901. It should be appreciated, however, that the protrusion may include other shapes and designs. For example, FIGS. 20-22 illustrate various alternate embodiments of engagement members having one or more protrusions.

Figure 20B:
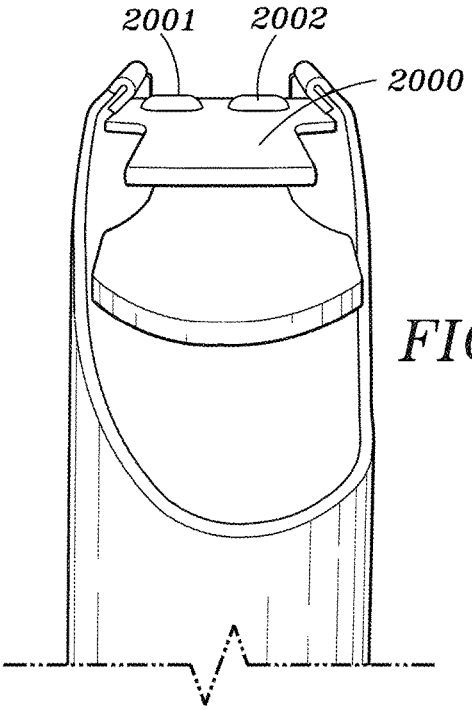
FIGS. 20A-20C illustrate various views of an example embodiment of an engagement member having two bar-shaped protrusions positioned opposite the center of the engagement member.
Figure 20A:
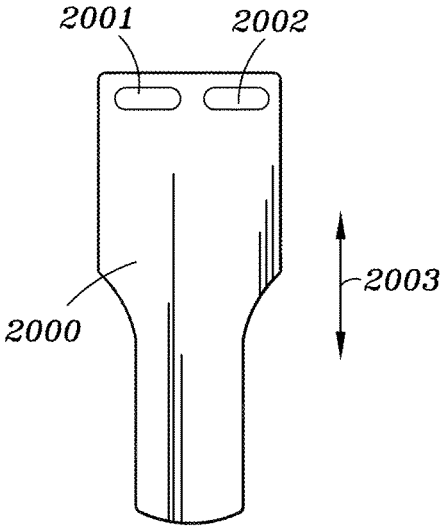
Figure 20C:
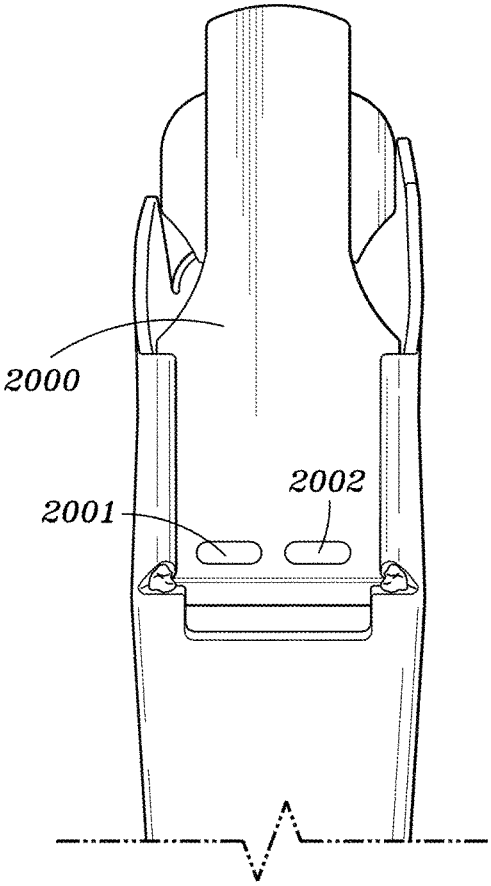

In the embodiment illustrated in FIGS. 20A-20C, the engagement member 2000 includes two protrusions 2001 and 2002. The protrusions 2001 and 2002 are bar-shaped protrusions positioned substantially perpendicular to the length 2003 of the engagement member 2000. Each protrusion 2001 and 2002 engages the annular recess of the cartridge 1000, thereby providing support on both sides of the cartridge 1000 to more accurately align and position the cartridge 1000 on the engagement member 2000 of the magazine follower. The engagement member 2000 is shown from an overhead view in FIG. 20A, from a front-facing view in FIG. 20B, and from a back-angled view in FIG. 20C.

Figure 21B:
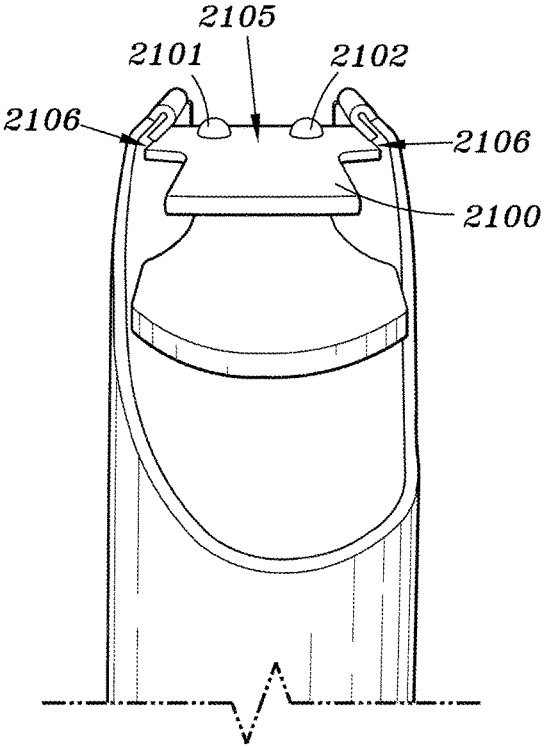
FIGS. 21A-21C illustrate various views of an example embodiment of an engagement member having two hemispherical protrusions positioned opposite the center of the engagement member.
Figure 21C:
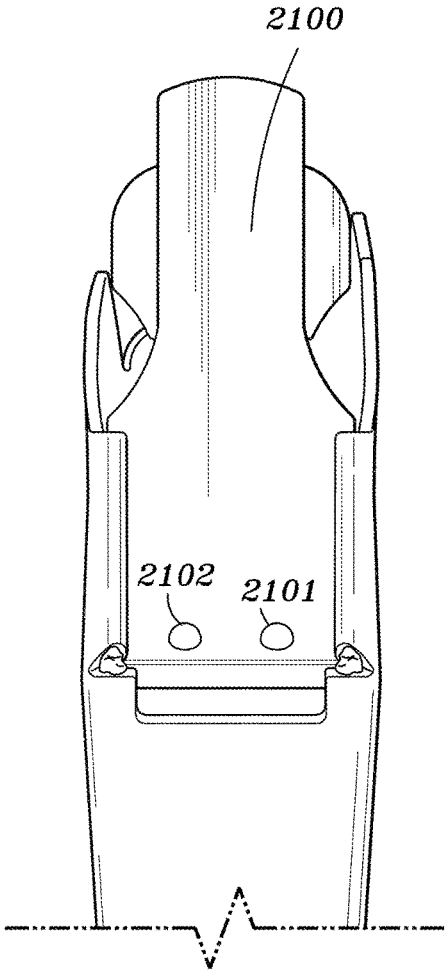
Figure 21A:
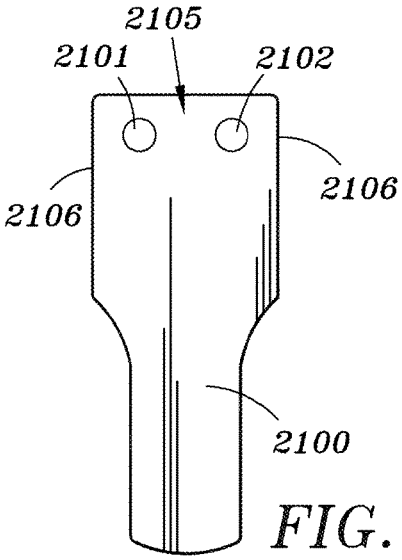

In the embodiment illustrated in FIGS. 21A-21C, the engagement member 2100 includes two protrusions 2101 and 2102. The protrusions 2101 and 2102 are hemispherical protrusions each positioned approximately half-way between the middle 2105 and sides 2106 of the engagement member 2100. By positioning the protrusions 2101 and 2102 between the middle 2105 and sides 2106, the protrusions

2101 and 2102 each engage the annular recess of the cartridge 1000, thereby providing support on both sides of the cartridge 1000 to more accurately align and position the cartridge 1000 on the engagement member 2100 of the magazine follower. Such support is not attainable by using a single hemispherical protrusion positioned in the middle 2105 of the engagement member 2100. The engagement member 2100 is shown from an overhead view in FIG. 21A, from a front-facing view in FIG. 21B, and from a back-angled view in FIG. 21C.

Figure 22A:
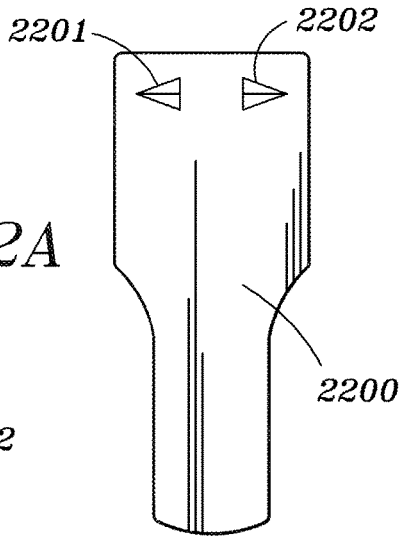
FIGS. 22A-22C illustrate various views of an example embodiment of an engagement member having two ramp-shaped protrusions positioned opposite the center of the engagement member.
Figure 22B:
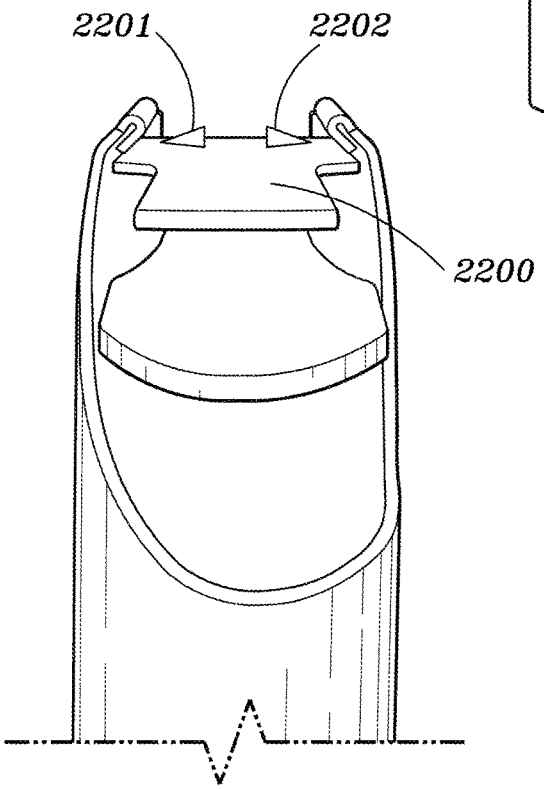
Figure 22C:
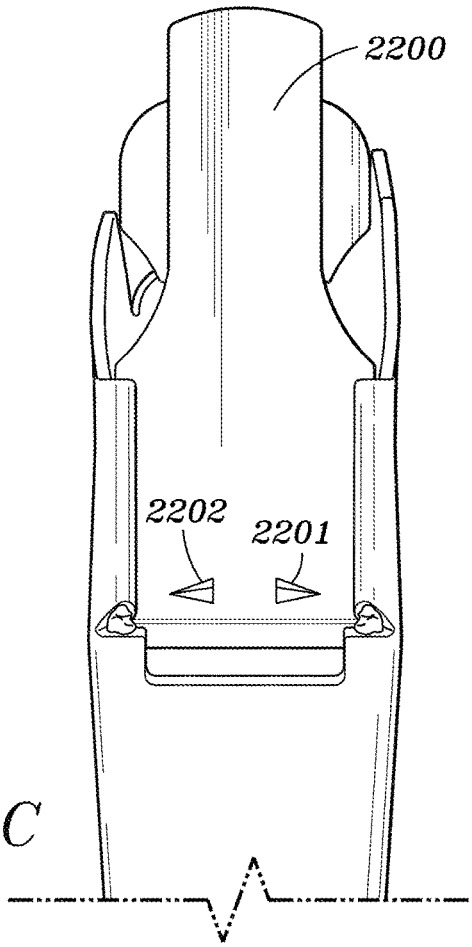

In the embodiment illustrated in FIGS. 22A-22C, the engagement member 2200 includes two protrusions 2201 and 2202. The protrusions 2201 and 2202 are ramped-shaped protrusions that increase in height as they approach the midpoint of the engagement member 2200. Each protrusion 2201 and 2202 engages the annular recess of the cartridge 1000, thereby providing support on both sides of the cartridge 1000 to more accurately align and position the cartridge 1000 on the engagement member 2200 of the magazine follower. The engagement member 2200 is shown from an overhead view in FIG. 22A, from a front-facing view in FIG. 22B, and from a back-angled view in FIG. 22C.

Figure 23A:
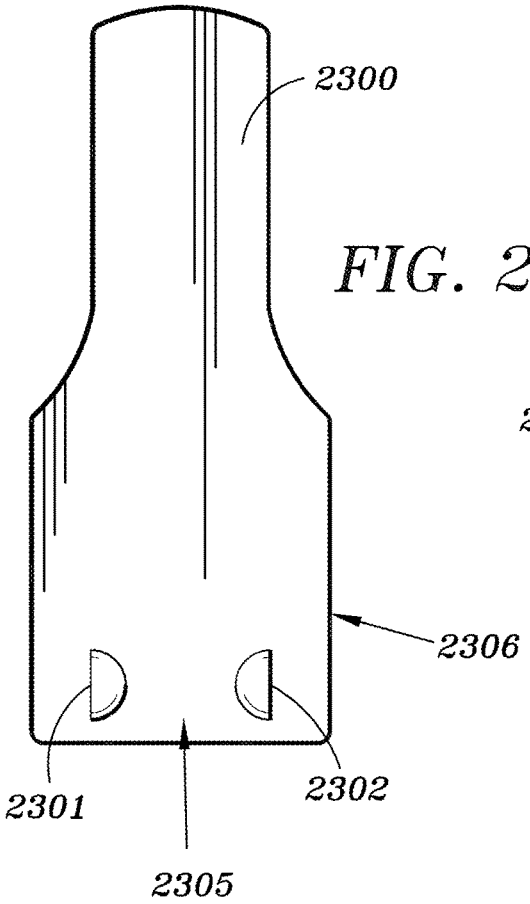
FIGS. 23A and 23B illustrate various views of an example embodiment of an engagement member having two semi-hemispherical protrusions positioned opposite the center of the engagement member.
Figure 23B:
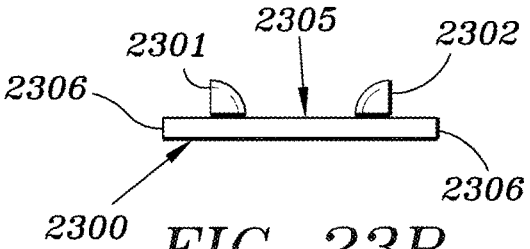

In the embodiment illustrated in FIGS. 23A and 23B, the engagement member 2300 includes two protrusions 2301 and 2302. The protrusions 2301 and 2302 are semi-hemispherical protrusions (i.e., half hemisphere or quarter sphere) each positioned approximately half-way between the middle 2305 and sides 2306 of the engagement member 2300. By positioning the protrusions 2301 and 2302 between the middle 2305 and sides 2306, the protrusions 2301 and 2302 each engage the annular recess of the cartridge 1000, thereby providing support on both sides of the cartridge 1000 to more accurately align and position the cartridge 1000 on the engagement member 2300 of the magazine follower. Such support is not attainable by using a single hemispherical protrusion positioned in the middle 2305 of the engagement member 2300. The engagement member 2300 is shown from an overhead view in FIG. 23A and from a rear-facing view in FIG. 23B.

The protrusion(s) may be formed by any process known in the art such as, for example, crimping, folding, cutting, soldering, or welding. In some embodiments the protrusion(s) may be formed from the engagement member, or may be a separate component that is attached to the engagement member. It should be appreciated that the protrusions may be any shape operable to retain the cartridge in accordance with the disclosure provided herein.

Referring again to FIGS. 19A-19C, the engagement member 1901 of the follower may, in some embodiments, be folded 1902 to provide a first arm 1901(A) and second arm 1901(B). The fold 1902 biases the first arm 1901(A) toward the top of the magazine to position the engaged cartridge 1000 at an angle such that subsequent cartridges positioned on top of the cartridge 1000 engage the recess 1906 of the engaged cartridge 1000. Subsequent cartridges are similarly positioned such that all the cartridges loaded into the magazine are interconnected and retained in the desired horizontal alignment.

Figure 13:
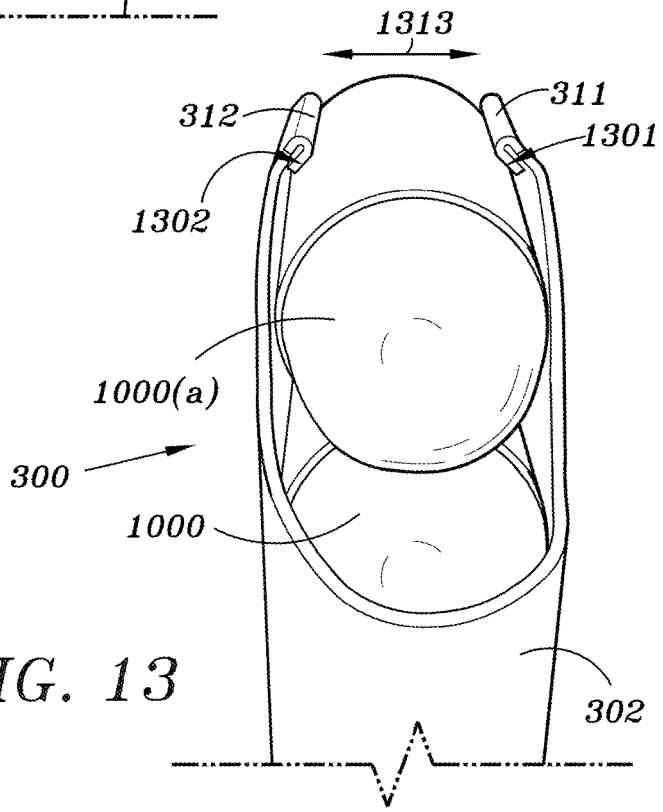
FIG. 13 illustrates a front view of the magazine of FIG. 3 with cartridges loaded into the magazine.
Figure 14:
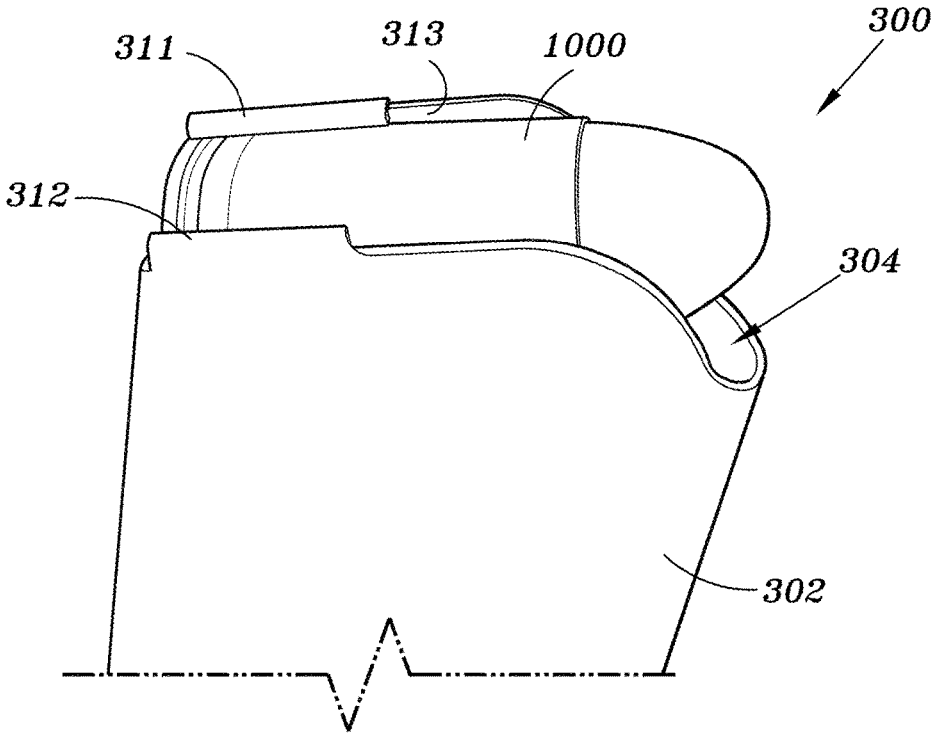
FIG. 14 illustrates a side view of the magazine of FIG. 3 with cartridges loaded into the magazine.

The foregoing features, namely, the folded feed lips and protrusions, comprise a system for retaining a cartridge in a magazine so as to achieve a desired position of the cartridges for loading into a firearm. The folded feed lips provide both vertical and lateral positioning of the cartridges, and the one or more protrusions provide for horizontal positioning of the cartridges. For example, referring briefly to FIG. 13, the folded feed lips 311 and 312 contact the sides of the uppermost cartridge 1000(*a*) at locations 1301 and 1302 at the ends of the first and second feed lips 311 and 312, respectively, thereby centering the cartridge 1000(*a*) in lateral alignment with the magazine 300 along line 1313. Additionally, the folded feed lips 311 and 312 retain the uppermost cartridge 1000(*a*) in a vertical position determined by the point at which the cartridge 1000(*a*) contacts the feed lips 311 and 312, as shown in FIG. 13. The vertical axis is generally represented by line 1616 illustrated in FIG. 16. As previously discussed, the one or more protrusions are formed on the engagement member such that the cartridge 1000 is positioned on the engagement member at a desired location along the length of the engagement member, thereby providing a horizontal alignment of the cartridge 1000 in the magazine. The horizontal alignment is represented generally by line 1900 in FIGS. 19A and 19C and by line 1610 in FIG. 16.

A number of additional and alternative embodiments of the disclosed system and method may be provided without departing from the spirit or scope of the present disclosure as set forth in the claims provided herein. For example, each feed lip may include more than one folded portion. In some embodiments, the entirety of the feed lips or portions of the feed lips such as, for example, the folded portions, may be fully or partially enclosed in an overmolding material such as, for example, a polymer. Thus, the feed lips, or portions of the feed lips (e.g., the folded portions) may serve as a framework or substructure of a magazine's feed lips providing strength, durability, and reinforced structural integrity as discussed herein. In such embodiments, the overmolding material may be formed such that the feed lips do not appear to have folded portions, yet the folded portions form a substructure of the feed lips. Still further, in such embodiments, the overmolding material may be formed such that the overmolded feed lips have folded portions defined by the underlying folded portions of the substructure material positioned within the overmolding material. The overmolded material (i.e., the framework or substructure) may include through holes (or voids, slots, or combinations thereof) to allow the polymer to form and bond through the holes, thereby yielding a solid bonding of the polymer both around the exterior of the substructure and in the through holes. In other embodiments, the magazine may have feed lips formed from a non-metal material (e.g., polymer) and having a folded portion inserted therein, wherein the inserted folded portion is a metal or non-metal material placed within the non-metal feed lip. These various embodiments are believed to be understood by one of ordinary skill in the art in view of the present disclosure.

What is claimed is:

1. A cartridge retention system for use in a magazine, the cartridge retention system comprising:

a housing having an opening and operable to retain one or more cartridges in an interior portion of the magazine;

a first feed lip coupled to and integral with the housing at the opening of the housing, wherein the first feed lip includes a first folded portion, wherein the first feed lip is folded toward the interior portion of the magazine, and wherein the first feed lip is operable to retain the one or more cartridges in the magazine at desired lateral and vertical positions;

a second feed lip coupled to and integral with the housing at the opening of the housing, wherein the second feed lip includes a first leg and a second leg, wherein the first leg extends from the housing toward the first feed lip, and the second leg extends from a U-shaped connector away from the first feed lip and wherein the U-shaped connector couples the first leg to the second leg, and wherein the second feed lip is operable to retain the one or more cartridges in the magazine at the desired lateral and vertical positions; and a follower disposed in the interior portion of the magazine and operable to bias the one or more cartridges towards the opening of the housing, the follower comprising an engagement member having one or more protrusions operable to engage an annular recess of one of the cartridges to retain the engaged cartridge at a desired horizontal alignment.

2. The cartridge retention system as set forth in claim 1, wherein the one or more protrusions are bar-shaped.

3. The cartridge retention system as set forth in claim 1, wherein the one or more protrusions include two hemispherical protrusions each positioned equidistant between a center of the engagement member and a side of the engagement member.

4. The cartridge retention system as set forth in claim 1, wherein the one or more protrusions include two ramp-shaped protrusions, wherein the two ramp-shaped protrusions increase in height in a direction toward the center of the engagement member.

5. The cartridge retention system as set forth in claim 1, wherein the one or more protrusions include two semi-hemispherical protrusions each positioned equidistant between a center of the engagement member and a side of the engagement member.

6. The cartridge retention system as set forth in claim 1, wherein the first feed lip is folded toward the interior portion of the magazine such that a point on the first feed lip and a point on a first interior surface of the housing correspond to two points along a circumference of an imaginary circle having a desired radius.

7. The cartridge retention system as set forth in claim 1, wherein the second feed lip is folded toward the interior portion of the magazine such that a point on the second feed lip and a point on a second interior surface of the housing correspond to two points along a circumference of an imaginary circle having a desired radius.

8. The cartridge retention system as set forth in claim 1, wherein the first leg of the second feed lip is straight and unbent; and wherein the second leg of the second feed lip is straight and unbent.

9. A cartridge retention system for use in a magazine, the cartridge retention system comprising:

a housing having an opening and operable to retain one or more cartridges in an interior portion of the magazine;

a first feed lip coupled to and integral with the housing at the opening of the housing, wherein the first feed lip includes a first folded leg and a second leg, wherein the first leg extends from the housing toward a second feed lip, and the second leg extends from a U-shaped connector away from the first feed lip and wherein the U-shaped connector couples the first leg to the second leg, and wherein the first feed lip is operable to retain the one or more cartridges in the magazine at desired lateral and vertical positions;

the second feed lip coupled to and integral with the housing at the opening of the housing, wherein the second feed lip includes a folded portion, wherein the second feed lip is folded toward the interior portion of the magazine, wherein the second feed lip is operable to retain the one or more cartridges in the magazine at the desired lateral and vertical positions; and a follower disposed in the interior portion of the magazine and operable to bias the one or more cartridges towards the opening of the housing, the follower comprising an engagement member having one or more protrusions operable to engage an annular recess of one of the cartridges to retain the engaged cartridge at a desired horizontal alignment.

10. The cartridge retention system as set forth in claim 9, wherein the one or more protrusions are bar-shaped.

11. The cartridge retention system as set forth in claim 9, wherein the one or more protrusions include two hemispherical protrusions each positioned equidistant between a center of the engagement member and a side of the engagement member.

12. The cartridge retention system as set forth in claim 9, wherein the one or more protrusions include two ramp-shaped protrusions, wherein the two ramp-shaped protrusions increase in height in a direction toward the center of the engagement member.

13. The cartridge retention system as set forth in claim 9, wherein the one or more protrusions include two semi-hemispherical protrusions each positioned equidistant between a center of the engagement member and a side of the engagement member.

14. The cartridge retention system as set forth in claim 9, wherein the first feed lip is folded toward the interior portion of the magazine such that a point on the first feed lip and a point on a first interior surface of the housing correspond to two points along a circumference of an imaginary circle having a desired radius.

15. The cartridge retention system as set forth in claim 9, wherein the second feed lip is folded toward the interior portion of the magazine such that a point on the second feed lip and a point on a second interior surface of the housing correspond to two points along a circumference of an imaginary circle having a desired radius.

16. The cartridge retention system as set forth in claim 9, wherein the first leg of the second feed lip is straight and unbent; and wherein the second leg of the second feed lip is straight and unbent.

* * * * *